US011378897B2

(12) United States Patent
Johnson, Jr. et al.

(10) Patent No.: US 11,378,897 B2
(45) **Date of Patent: *Jul. 5, 2022**

(54) TONER CONTAINER HAVING AN ENCODED MEMBER AND AN ALIGNMENT GUIDE FOR LOCATING A SENSOR RELATIVE TO THE ENCODED MEMBER

(71) Applicant: LEXMARK INTERNATIONAL, INC., Lexington, KY (US)

(72) Inventors: Virgil Johnson, Jr., Versailles, KY (US); Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/242,771

(22) Filed: Apr. 28, 2021

(65) Prior Publication Data

US 2021/0247704 A1 Aug. 12, 2021

Related U.S. Application Data

(63) Continuation of application No. 16/820,962, filed on Mar. 17, 2020, now Pat. No. 11,022,909, which is a continuation-in-part of application No. 16/690,203, filed on Nov. 21, 2019, now Pat. No. 10,859,944, which is a continuation of application No. (Continued)

(51) Int. Cl.
*G03G 15/08* (2006.01)
*G03G 21/18* (2006.01)

(52) U.S. Cl.
CPC ..... *G03G 15/0867* (2013.01); *G03G 15/0889* (2013.01); *G03G 15/0891* (2013.01); *G03G 21/1896* (2013.01); *G03G 2215/0675* (2013.01)

(58) Field of Classification Search
CPC ..... G03G 15/0867; G03G 15/0889; G03G 15/0891; G03G 21/1896; G03G 2215/0675; G03G 15/0863; G03G 21/1875
See application file for complete search history.

(56) References Cited

U.S. PATENT DOCUMENTS 5,634,169 A * 5/1997 Barry ..... G03G 21/1896 399/12
5,995,772 A * 11/1999 Barry ..... G03G 21/1896 399/12

(Continued)

*Primary Examiner* — Sandra Brase
(74) *Attorney, Agent, or Firm* — Justin M. Tromp

(57) ABSTRACT

A toner container includes an encoded member that is encoded with identifying information of the toner container and that is operatively connected to an input gear of the toner container such that rotation of the input gear causes movement of the encoded member for communicating the identifying information to a sensor. A first alignment guide on the first side of the toner container includes a top surface that is unobstructed to contact a sensor housing from below when the toner container is installed in an image forming device. At least a portion of the top surface of the first alignment guide inclines upward and rearward for contacting and lifting the sensor housing upward during insertion of the toner container into the image forming device for aligning the sensor with an exposed portion of the encoded member.

12 Claims, 17 Drawing Sheets

Related U.S. Application Data

16/157,495, filed on Oct. 11, 2018, now Pat. No. 10,527,967.

(60) Provisional application No. 62/822,088, filed on Mar. 22, 2019.

(56) References Cited

U.S. PATENT DOCUMENTS

| | | | | |
|---|---|---|---|---|
| 11,022,909 | B2 * | 6/2021 | Johnson, Jr. ..... | G03G 15/0867 |
| 11,022,910 | B2 * | 6/2021 | Johnson, Jr. ..... | G03G 15/0867 |
| 2001/0036368 | A1 * | 11/2001 | Curry ..... | G03G 21/1896 399/12 |
| 2021/0247705 | A1 | 8/2021 | Johnson, Jr. et al. | |

* cited by examiner

TONER CONTAINER HAVING AN ENCODED MEMBER AND AN ALIGNMENT GUIDE FOR LOCATING A SENSOR RELATIVE TO THE ENCODED MEMBER

CROSS REFERENCES TO RELATED APPLICATIONS

This application is a continuation application of U.S. patent application Ser. No. 16/820,962, filed Mar. 17, 2020, entitled "Toner Container Having an Encoded Member and an Alignment Guide for Locating a Sensor Relative to the Encoded Member," which is a continuation-in-part application of U.S. patent application Ser. No. 16/690,203, filed Nov. 21, 2019, now U.S. Pat. No. 10,859,944, issued Dec. 8, 2020, entitled "Toner Container Having a Common Input Gear for a Toner Agitator Assembly and an Encoded Member," which is a continuation application of U.S. patent application Ser. No. 16/157,495, filed Oct. 11, 2018, now U.S. Pat. No. 10,527,967, issued Jan. 7, 2020, entitled "Toner Container Having a Common Input Gear for a Toner Agitator Assembly and an Encoded Member." U.S. patent application Ser. No. 16/820,962, filed Mar. 17, 2020, entitled "Toner Container Having an Encoded Member and an Alignment Guide for Locating a Sensor Relative to the Encoded Member" also claims priority to U.S. Provisional Patent Application Ser. No. 62/822,088, filed Mar. 22, 2019, entitled "Toner Container Having an Encoded Member and Positioning Features for Locating a Sensor Relative to the Encoded Member," the content of which is hereby incorporated by reference in its entirety.

BACKGROUND

1. Field of the Disclosure

The present disclosure relates generally to image forming devices and more particularly to a toner container having an encoded member and an alignment guide for locating a sensor relative to the encoded member.

2. Description of the Related Art

In electrophotographic image forming devices, one or more replaceable toner containers may be used to supply toner for printing onto sheets of media. Each toner container often includes a toner agitator assembly that agitates and mixes toner stored in a toner reservoir to prevent the toner from clumping and that moves the toner to an outlet of the toner container. It is often desired for each toner container to communicate characteristics of the toner container to the image forming device for proper operation. For example, it may be desired to communicate such information as authentication or validation information, toner fill amount, toner color, toner type, etc.

SUMMARY

A toner container for use in an electrophotographic image forming device according to one example embodiment includes a housing having a top, a bottom, a front and a rear positioned between a first side and a second side of the housing of the toner container. The housing of the toner container has a reservoir for holding toner. An outlet on the front of the housing of the toner container is in fluid communication with the reservoir for exiting toner from the toner container. An input gear is positioned at the first side of the housing of the toner container for mating with a corresponding output gear in the image forming device when the toner container is installed in the image forming device. The toner container includes an encoded member that is encoded with identifying information of the toner container and that is operatively connected to the input gear such that rotation of the input gear causes movement of the encoded member for communicating the identifying information of the toner container to a sensor of the image forming device when the toner container is installed in the image forming device. At least a portion of the encoded member is exposed on the first side of the housing of the toner container. A first alignment guide on the first side of the housing of the toner container is positioned axially outboard of the encoded member relative to a rotational axis of the input gear and is positioned below an exposed portion of the encoded member. The first alignment guide includes a top surface that is unobstructed to contact a sensor housing in the image forming device from below when the toner container is installed in the image forming device. At least a portion of the top surface of the first alignment guide inclines upward and rearward toward the top and the rear of the housing of the toner container for contacting and lifting the sensor housing in the image forming device upward during insertion of the toner container into the image forming device with the front of the housing of the toner container leading the insertion for aligning the sensor of the image forming device with the exposed portion of the encoded member.

Embodiments include those wherein the encoded member is rotatably connected to the input gear such that rotation of the input gear causes rotation of the encoded member. In some embodiments, the encoded member is positioned on an axially outboard face of the input gear that faces away from the reservoir. In some embodiments, the top surface of the first alignment guide includes a front portion and a rear portion. The front portion of the top surface of the first alignment guide is positioned closer to the front of the housing of the toner container than the rear portion of the top surface of the first alignment guide is to the front of the housing of the toner container. The front portion of the top surface of the first alignment guide inclines upward and rearward toward the top and the rear of the housing of the toner container. At least a portion of the rear portion of the top surface of the first alignment guide is positioned higher than the rotational axis of the input gear. In some embodiments, at least a portion of the rear portion of the top surface of the first alignment guide extends rearward of the rotational axis of the input gear.

Embodiments include those wherein the first alignment guide extends outward sideways from the first side of the housing of the toner container.

Some embodiments include a second alignment guide on the first side of the housing of the toner container. In some embodiments, the second alignment guide includes a frontward facing surface that faces toward the front of the housing of the toner container. The frontward facing surface extends upward from a rear end of the top surface of the first alignment guide. The frontward facing surface is unobstructed to contact the sensor housing in the image forming device when the toner container is installed in the image forming device for limiting a position of the sensor of the image forming device in a direction from the front of the housing of the toner container toward the rear of the housing of the toner container.

In some embodiments, the second alignment guide includes a first guide surface and a second guide surface. The second guide surface is positioned rearward of the first guide surface such that the second guide surface is positioned closer to the rear of the housing of the toner container than the first guide surface is to the rear of the housing of the toner container. The first guide surface inclines outward sideways and rearward away from the first side and toward the rear of the housing of the toner container. The second guide surface inclines inward sideways and rearward toward the second side and toward the rear of the housing of the toner container. The first and second guide surfaces are unobstructed to contact the sensor housing in the image forming device during insertion of the toner container into the image forming device for moving the sensor housing in the image forming device axially relative to the rotational axis of the input gear during insertion of the toner container into the image forming device. In some embodiments, the second alignment guide leads rearward along the first side of the housing of the toner container to the exposed portion of the encoded member. In some embodiments, at least a portion of each of the first and second guide surfaces is positioned closer to the front of the housing of the toner container than the exposed portion of the encoded member is to the front of the housing of the toner container, and at least a portion of each of the first and second guide surfaces is positioned higher than a portion of the top surface of the first alignment guide.

A toner container for use in an electrophotographic image forming device according to another example embodiment includes a housing having a top, a bottom, a front and a rear positioned between a first side and a second side of the housing of the toner container. The housing of the toner container has a reservoir for holding toner. An outlet on the front of the housing of the toner container is in fluid communication with the reservoir for exiting toner from the toner container. An input gear is positioned at the first side of the housing of the toner container for mating with a corresponding output gear in the image forming device when the toner container is installed in the image forming device. The toner container includes an encoded member that is encoded with identifying information of the toner container and that is rotatably connected to the input gear such that rotation of the input gear causes rotation of the encoded member for communicating the identifying information of the toner container to a sensor of the image forming device when the toner container is installed in the image forming device. The encoded member is positioned on an axially outboard face of the input gear that faces away from the reservoir. A first alignment guide on the first side of the housing of the toner container is positioned axially outboard of the encoded member relative to a rotational axis of the input gear. The first alignment guide overlaps with the axially outboard face of the input gear as viewed from the first side of the housing of the toner container. The first alignment guide includes a top surface that is unobstructed to contact a sensor housing in the image forming device from below when the toner container is installed in the image forming device. At least a portion of the top surface of the first alignment guide inclines upward and rearward toward the top and the rear of the housing of the toner container for contacting and lifting the sensor housing in the image forming device upward during insertion of the toner container into the image forming device with the front of the housing of the toner container leading the insertion for aligning the sensor of the image forming device with the encoded member.

Embodiments include those wherein the top surface of the first alignment guide includes a front portion and a rear portion. The front portion of the top surface of the first alignment guide is positioned closer to the front of the housing of the toner container than the rear portion of the top surface of the first alignment guide is to the front of the housing of the toner container. The front portion of the top surface of the first alignment guide inclines upward and rearward toward the top and the rear of the housing of the toner container. At least a portion of the rear portion of the top surface of the first alignment guide is positioned higher than the rotational axis of the input gear. In some embodiments, at least a portion of the rear portion of the top surface of the first alignment guide extends rearward of the rotational axis of the input gear.

Embodiments include those wherein the first alignment guide extends outward sideways from the first side of the housing of the toner container.

Some embodiments include a second alignment guide on the first side of the housing of the toner container. In some embodiments, the second alignment guide includes a frontward facing surface that faces toward the front of the housing of the toner container. The frontward facing surface extends upward from a rear end of the top surface of the first alignment guide. The frontward facing surface is unobstructed to contact the sensor housing in the image forming device when the toner container is installed in the image forming device for limiting a position of the sensor of the image forming device in a direction from the front of the housing of the toner container toward the rear of the housing of the toner container.

In some embodiments, the second alignment guide includes a first guide surface and a second guide surface. The second guide surface is positioned rearward of the first guide surface such that the second guide surface is positioned closer to the rear of the housing of the toner container than the first guide surface is to the rear of the housing of the toner container. The first guide surface inclines outward sideways and rearward away from the first side and toward the rear of the housing of the toner container. The second guide surface inclines inward sideways and rearward toward the second side and toward the rear of the housing of the toner container. The first and second guide surfaces are unobstructed to contact the sensor housing in the image forming device during insertion of the toner container into the image forming device for moving the sensor housing in the image forming device axially relative to the rotational axis of the input gear during insertion of the toner container into the image forming device. In some embodiments, at least a portion of each of the first and second guide surfaces is positioned closer to the front of the housing of the toner container than the rotational axis of the input gear is to the front of the housing of the toner container, and at least a portion of each of the first and second guide surfaces is positioned higher than a portion of the top surface of the first alignment guide.

A toner container for use in an electrophotographic image forming device according to another example embodiment includes a housing having a top, a bottom, a front and a rear positioned between a first side and a second side of the housing of the toner container. The housing of the toner container has a reservoir for holding toner. An outlet on the front of the housing of the toner container is in fluid communication with the reservoir for exiting toner from the toner container. An input gear is positioned at the first side of the housing of the toner container for mating with a corresponding output gear in the image forming device when the toner container is installed in the image forming device. The toner container includes an encoded member that is encoded with identifying information of the toner container and that is operatively connected to the input gear such that rotation of the input gear causes movement of the encoded member for communicating the identifying information of the toner container to a sensor of the image forming device when the toner container is installed in the image forming device. At least a portion of the encoded member is exposed on the first side of the housing of the toner container. A first alignment guide on the first side of the housing of the toner container leads rearward along the first side of the housing of the toner container to the exposed portion of the encoded member. The first alignment guide includes a first guide surface that inclines outward sideways and rearward away from the first side and toward the rear of the housing of the toner container. The first guide surface is unobstructed to contact a sensor housing in the image forming device during insertion of the toner container into the image forming device with the front of the housing of the toner container leading the insertion for moving the sensor housing in the image forming device axially relative to a rotational axis of the input gear during insertion of the toner container into the image forming device.

Embodiments include those wherein the encoded member is rotatably connected to the input gear such that rotation of the input gear causes rotation of the encoded member. In some embodiments, the encoded member is positioned on an axially outboard face of the input gear that faces away from the reservoir. In some embodiments, at least a portion of the first guide surface is positioned closer to the front of the housing of the toner container than the rotational axis of the input gear is to the front of the housing of the toner container, and at least a portion of the first guide surface is positioned higher than the rotational axis of the input gear.

Embodiments include those wherein the first alignment guide includes a second guide surface that is positioned rearward of the first guide surface such that the second guide surface is positioned closer to the rear of the housing of the toner container than the first guide surface is to the rear of the housing of the toner container. The second guide surface inclines inward sideways and rearward toward the second side and toward the rear of the housing of the toner container. The second guide surface is unobstructed to contact the sensor housing in the image forming device during insertion of the toner container into the image forming device for moving the sensor housing in the image forming device axially relative to the rotational axis of the input gear during insertion of the toner container into the image forming device.

Some embodiments include a second alignment guide on the first side of the housing of the toner container. The second alignment guide is positioned axially outboard of the encoded member relative to the rotational axis of the input gear and is positioned below the exposed portion of the encoded member. The second alignment guide includes a top surface that is unobstructed to contact the sensor housing in the image forming device from below when the toner container is installed in the image forming device. At least a portion of the top surface of the second alignment guide inclines upward and rearward toward the top and the rear of the housing of the toner container for contacting and lifting the sensor housing in the image forming device upward during insertion of the toner container into the image forming device for aligning the sensor of the image forming device with the exposed portion of the encoded member.

Some embodiments further include a third alignment guide on the first side of the housing of the toner container. The third alignment guide includes a frontward facing surface that faces toward the front of the housing of the toner container. The frontward facing surface extends upward from a rear end of the top surface of the second alignment guide. The frontward facing surface is unobstructed to contact the sensor housing in the image forming device when the toner container is installed in the image forming device for limiting a position of the sensor of the image forming device in a direction from the front of the housing of the toner container toward the rear of the housing of the toner container.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
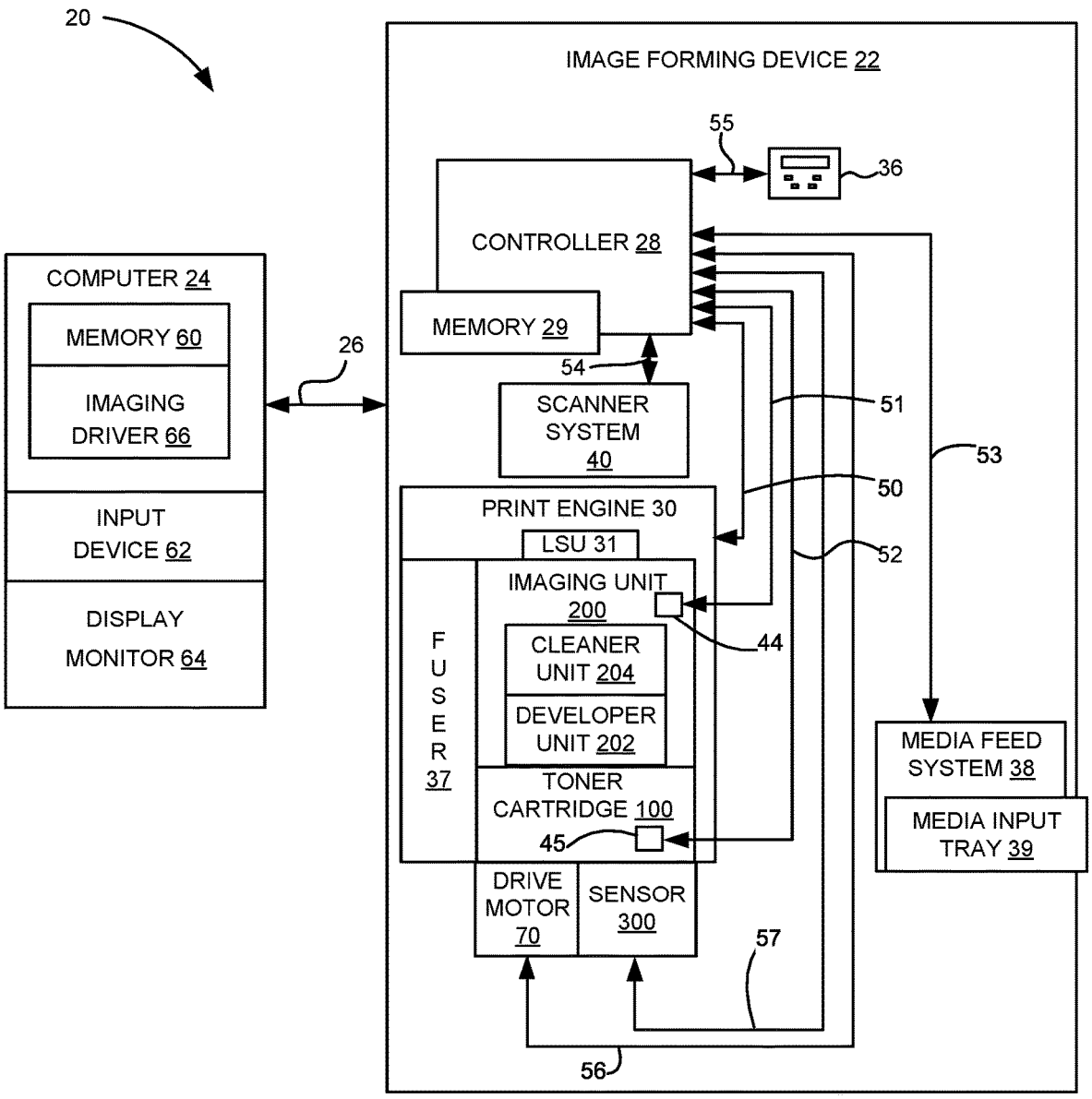
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39, a scanner system 40, a drive motor 70 and a sensor 300. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 communicates with drive motor 70 via a communications link 56. Controller 28 communicates with sensor 300 via a communications link 57. Controller 28 processes print and scan data and operates print engine 30 during printing and scanner system 40 during scanning. Processing circuitry 44, 45 may provide authentication functions, safety and operational interlocks, operating parameters and usage information related to imaging unit 200 and toner cartridge 100, respectively. Each of processing circuitry 44, 45 includes a processor unit and associated electronic memory. As discussed above, the processor may include one or more integrated circuits in the form of a microprocessor or central processing unit and may include one or more application-specific integrated circuits (ASICs). The memory may be any volatile or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and a fuser 37, all mounted within image forming device 22. Imaging unit 200 is removably mounted in image forming device 22 and includes a developer unit 202 that houses a toner reservoir and a toner development system. In one embodiment, the toner development system utilizes what is commonly referred to as a single component development system. In this embodiment, the toner development system includes a toner adder roll that provides toner from the toner reservoir of developer unit 202 to a developer roll. A doctor blade provides a metered uniform layer of toner on the surface of the developer roll. In another embodiment, the toner development system utilizes what is commonly referred to as a dual component development system. In this embodiment, toner in the toner reservoir of developer unit 202 is mixed with magnetic carrier beads. The magnetic carrier beads may be coated with a polymeric film to provide triboelectric properties to attract toner to the carrier beads as the toner and the magnetic carrier beads are mixed in the toner reservoir of developer unit 202. In this embodiment, developer unit 202 includes a magnetic roll that attracts the magnetic carrier beads having toner thereon to the magnetic roll through the use of magnetic fields. Imaging unit 200 also includes a cleaner unit 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner reservoir in developer unit 202.

The electrophotographic printing process is well known in the art and, therefore, is described briefly herein. During a printing operation, laser scan unit 31 creates a latent image on the photoconductive drum in cleaner unit 204. Toner is transferred from the toner reservoir in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
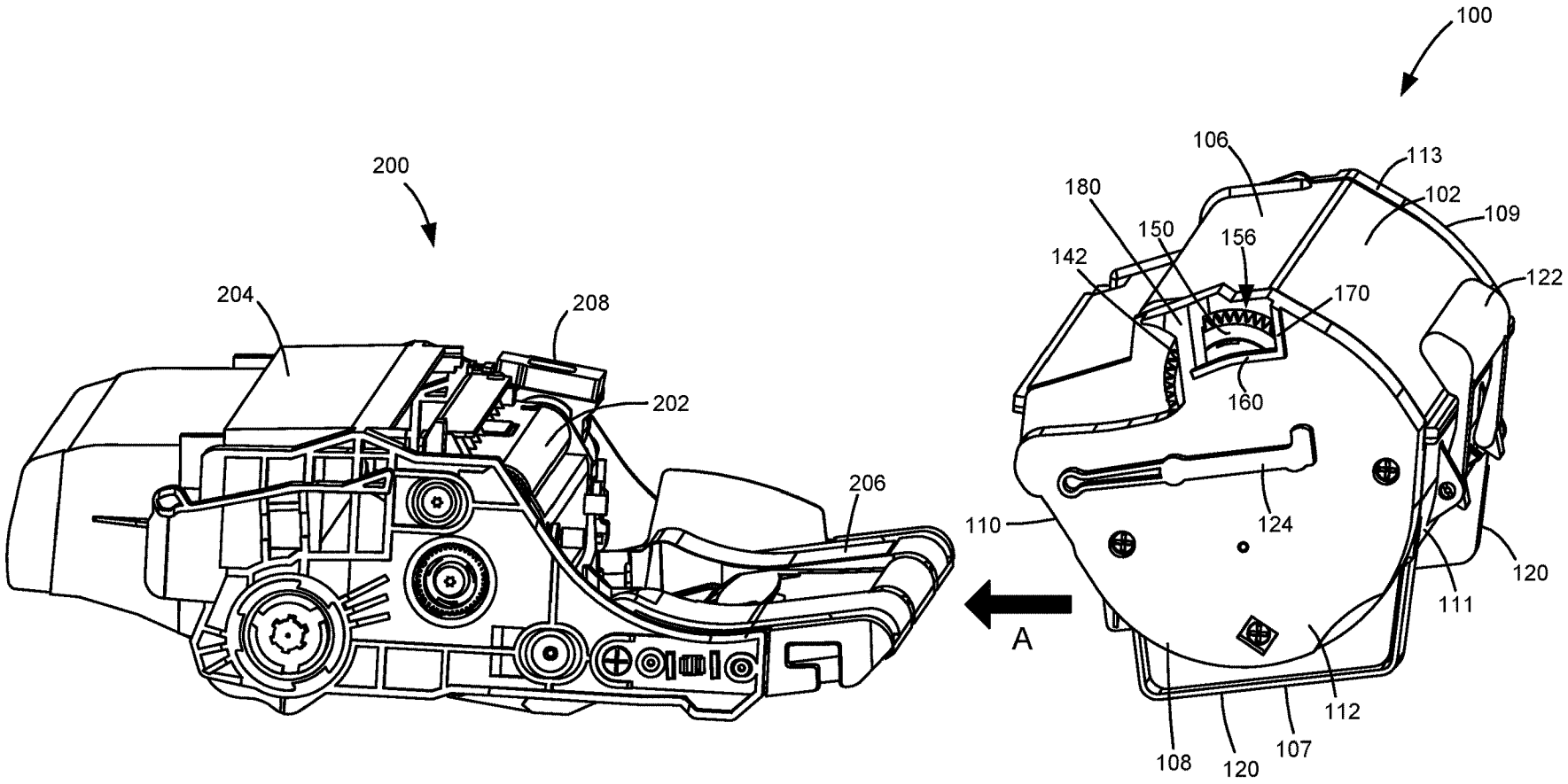
FIG. 2 is a perspective view of a toner cartridge and an imaging unit according to one example embodiment.

Referring now to FIG. 2, toner cartridge 100 and imaging unit 200 are shown according to one example embodiment. Imaging unit 200 includes a developer unit 202 and a cleaner unit 204 mounted on a common frame 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow A shown in FIG. 2, which also indicates the direction of insertion of imaging unit 200 and toner cartridge 100 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. In this embodiment, housing 102 includes main body 116 as well as various attachments (direct and indirect) thereto forming the overall body of toner cartridge 100 including, for example, end caps 112, 113. An outlet port 118 in fluid communication with reservoir 104 is positioned on front 110 of housing 102 near side 109 for exiting toner from toner cartridge 100. Housing 102 may include legs 120 on bottom 107 to assist with the insertion of toner cartridge 100 into image forming device 22 and to support housing 102 when toner cartridge 100 is set on a flat surface. A handle 122 may be provided on top 106 or rear 111 of housing 102 to assist with insertion and removal of toner cartridge 100 into and out of image forming device 22.

Figure 3:
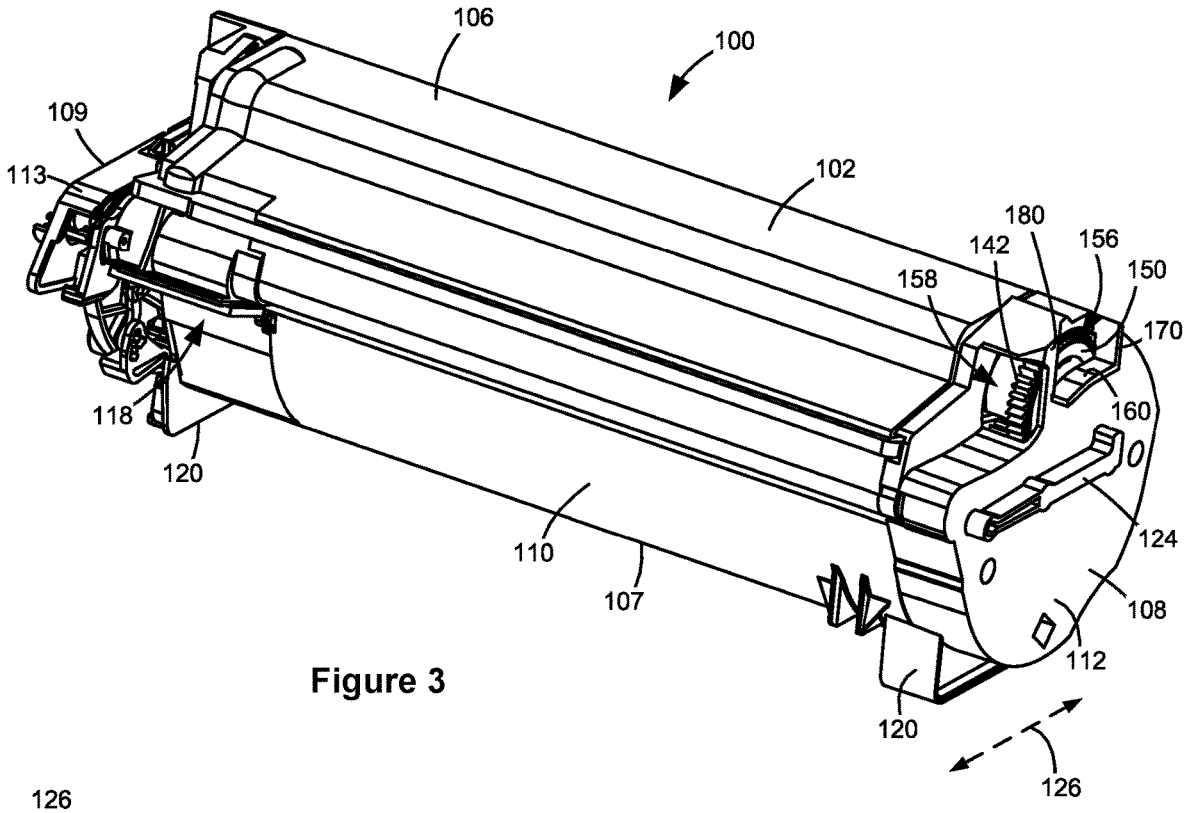
FIG. 3 is a front perspective view of the toner cartridge shown in FIG. 2.
Figure 4:
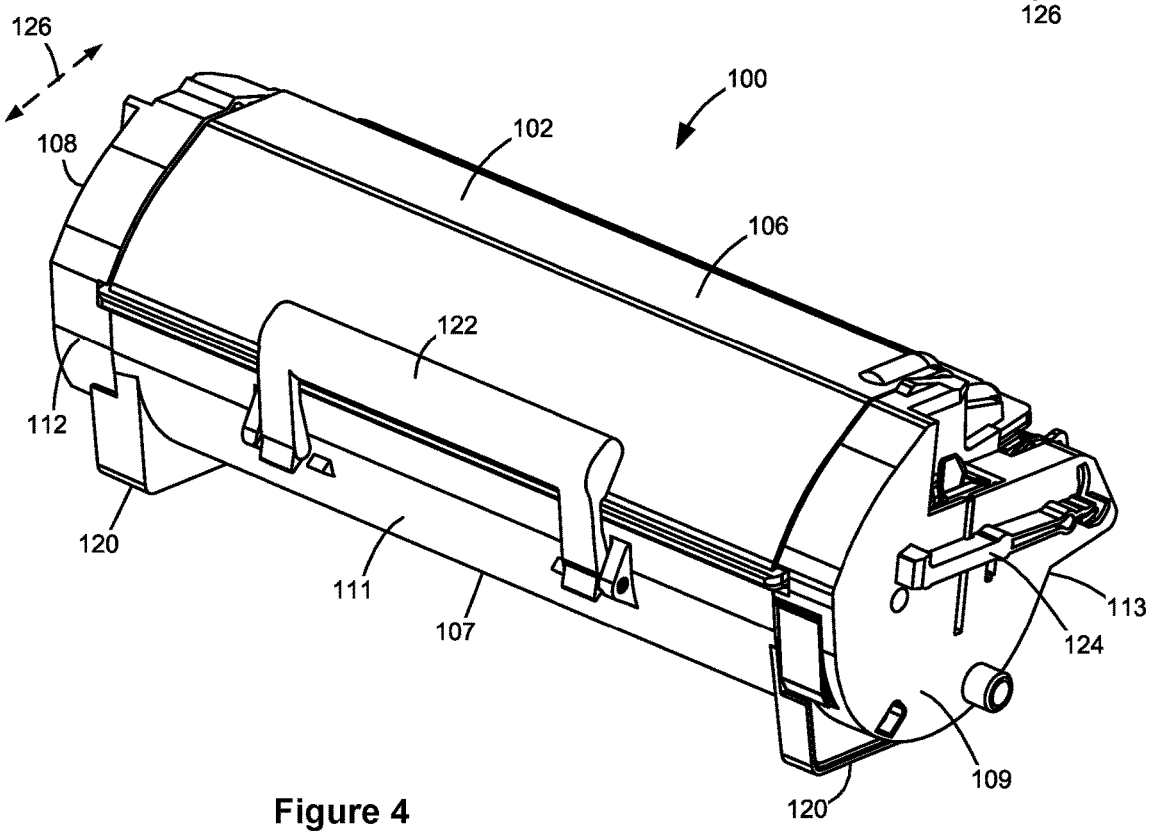
FIG. 4 is a rear perspective view of the toner cartridge shown in FIGS. 2 and 3.

Sides 108, 109 may each include a positioning guide 124 that extends outward from the respective side 108, 109 to assist the insertion of toner cartridge 100 into image forming device 22. Positioning guides 124 travel in corresponding guide slots in image forming device 22 that guide the insertion of toner cartridge 100 into image forming device 22. In the example embodiment illustrated, a positioning guide 124 is positioned on the outer side of each end cap 112, 113. Positioning guides 124 may run along a front-to-rear dimension 126 of housing 102, which extends from front 110 to rear 111, as shown in FIGS. 3 and 4.

Figure 5:
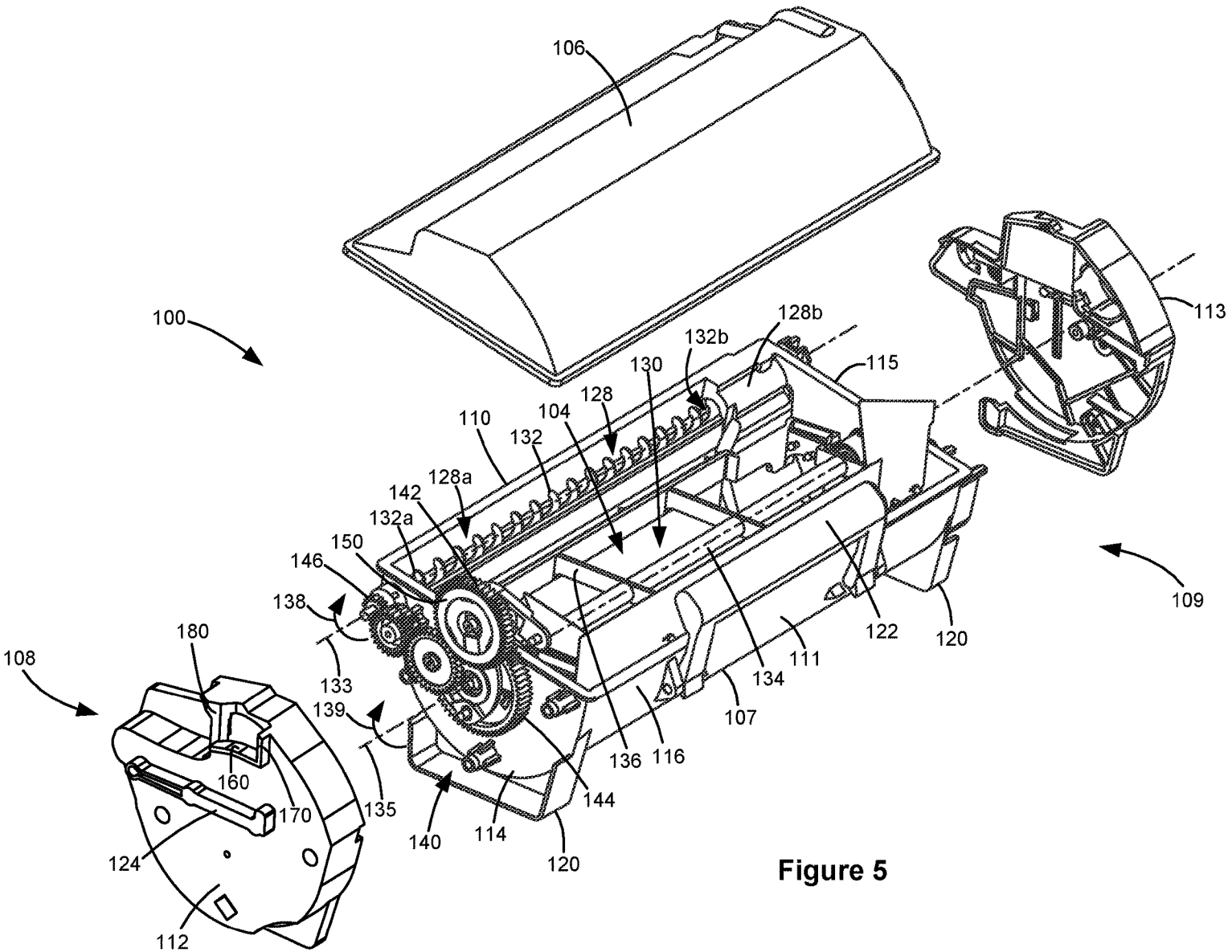
FIG. 5 is an exploded view of the toner cartridge shown in FIGS. 2-4 showing a toner agitator assembly of the toner cartridge according to one example embodiment.

With reference to FIG. 5, in the example embodiment illustrated, a toner agitator assembly 130 is rotatably positioned within toner reservoir 104. Toner agitator assembly 130 includes an auger 132 having first and second ends 132*a*, 132*b* and a spiral screw flight. Auger 132 is positioned in a channel 128 that runs along the front 110 of housing 102 from side wall 114 to side wall 115. Channel 128 is oriented generally horizontal when toner cartridge 100 is installed in image forming device 22. Auger 132 includes a rotational axis 133. In operation, auger 132 rotates in an operative rotational direction 138. Rotation of auger 132 in operative rotational direction 138 delivers toner in channel 128 to outlet port 118, which is positioned at the bottom of channel 128 so that gravity assists in exiting toner through outlet port 118. Channel 128 includes an open portion 128*a* and may include an enclosed portion 128*b*. Open portion 128*a* is open to toner reservoir 104 and extends from side wall 114 toward second end 132*b* of auger 132. Enclosed portion 128*b* of channel 128 extends from side wall 115 and encloses second end 132*b* of auger 132. In this embodiment, outlet port 118 is positioned at the bottom of enclosed portion 128*b* of channel 128.

Toner agitator assembly 130 also includes a rotatable drive shaft 134 and one or more toner agitators 136 in the form of extensions outward from drive shaft 134. Drive shaft 134 includes a rotational axis 135. In the example embodiment illustrated, rotational axis 135 of drive shaft 134 is parallel to rotational axis 133 of auger 132. In operation, drive shaft 134 rotates in an operative rotational direction 139. Toner agitators 136 rotate with drive shaft 134 around rotational axis 135 when drive shaft 134 rotates in operative rotational direction 139. As drive shaft 134 rotates in operative rotational direction 139, toner agitators 136 agitate and mix the toner stored in toner reservoir 104 and, in the embodiment illustrated, move toner toward channel 128 where auger 132 moves the toner to outlet port 118. In the example embodiment illustrated, first and second ends of drive shaft 134 extend through aligned openings in side walls 114, 115, respectively. However, drive shaft 134 may take other positions and orientations as desired. Bushings may be provided on an inner side of each side wall 114, 115 where drive shaft 134 passes through side walls 114, 115.

A drive train 140 on housing 102 is operatively connected to auger 132 and drive shaft 134 and may be positioned within a space formed between end cap 112 and side wall 114. Drive train 140 includes an input gear 142 that engages with a corresponding output gear in image forming device 22 that provides rotational motion from drive motor 70 in image forming device 22 to input gear 142. Input gear 142 is rotatable about a rotational axis 141. In the embodiment illustrated, rotational axis 141 is orthogonal to front-to-rear dimension 126. As shown in FIG. 3, in one embodiment, a front portion of input gear 142 is exposed at the front 110 of housing 102 near the top 106 of housing 102 where input gear 142 engages the output gear in image forming device 22. In the embodiment illustrated, a front portion of input gear 142 is exposed in a cutout 158 formed in a front portion of end cap 112. With reference back to FIG. 5, in the embodiment illustrated, drive train 140 also includes a drive gear 144 on one end of drive shaft 134 that is connected to input gear 142 either directly or via one or more intermediate gears to rotate drive shaft 134. In the embodiment illustrated, drive train 140 also includes a drive gear 146 on first end 132*a* of auger 132 that is connected to input gear 142 either directly or via one or more intermediate gears to rotate auger 132.

Figure 6:
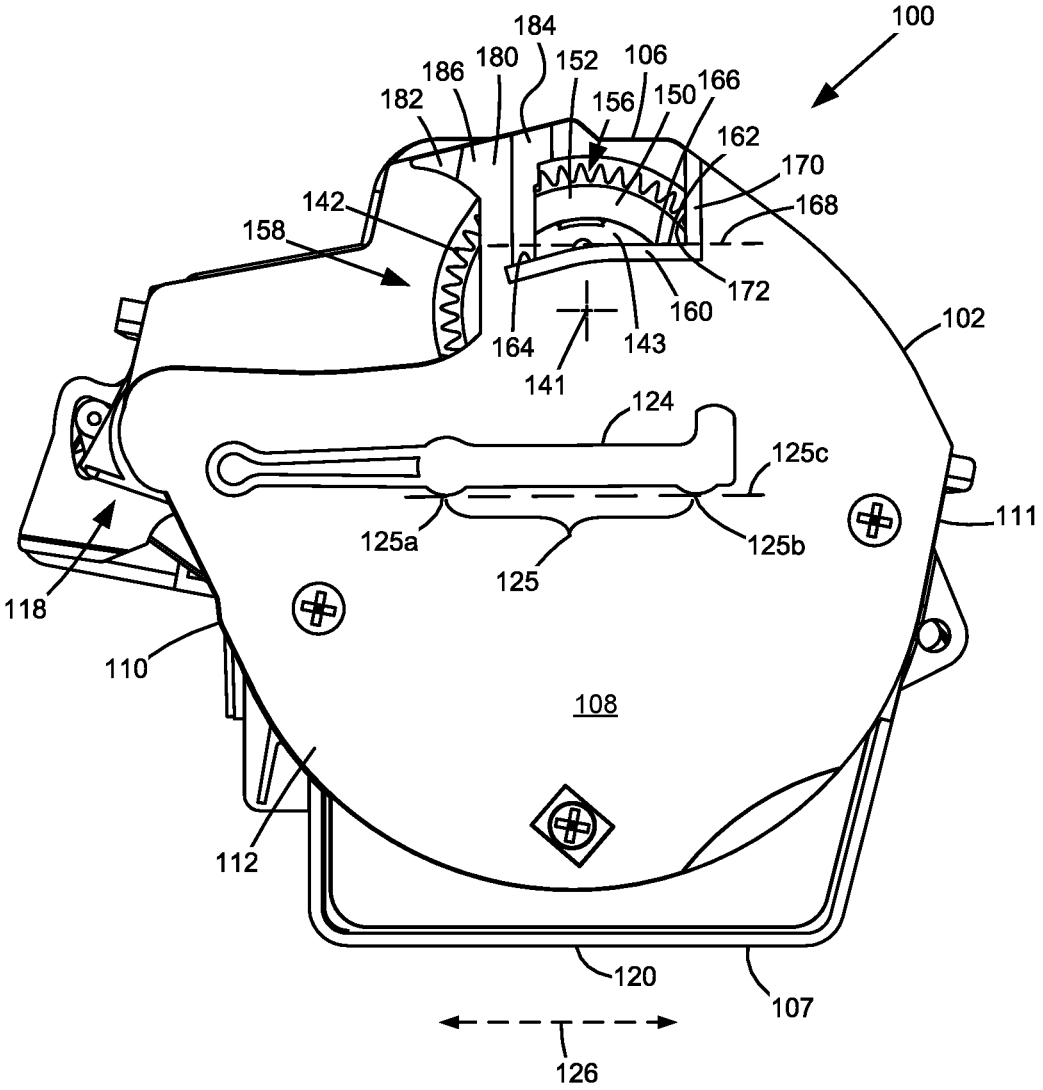
FIG. 6 is a side elevation view of the toner cartridge shown in FIGS. 2-5 showing an encoded member of the toner cartridge according to one example embodiment.
Figure 7:
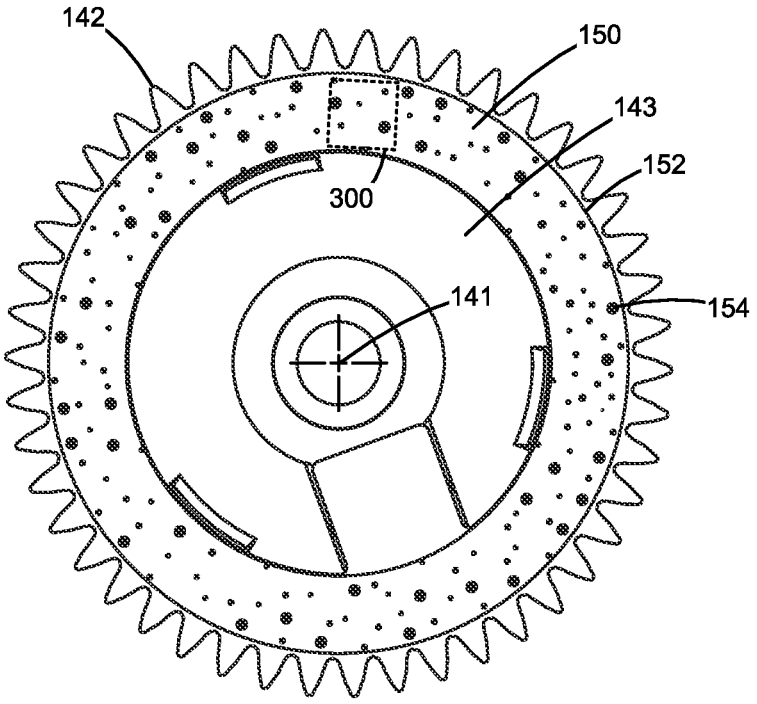
FIG. 7 is a side elevation view of the encoded member of the toner cartridge according to one example embodiment.

With reference to FIGS. 5-7, toner cartridge 100 includes an encoded member 150 that is movably connected to drive train 140, either directly or indirectly to input gear 142. In the example embodiment illustrated, encoded member 150 includes a rotatable disk 152 operatively connected to drive train 140, such as, for example, positioned on an outboard face 143 of input gear 142, coaxially with input gear 142 as illustrated. Disk 152 may be formed integrally with input gear 142 or separately attached to input gear 142. In other embodiments, encoded member 150 is, for example, translatable, such as by way of a rack and pinion arrangement or a cam and follower arrangement. Information pertaining to toner cartridge 100 is encoded on encoded member 150. Encoded member 150 is detectable by sensor 300 in image forming device 22 when toner cartridge 100 is installed in image forming device 22 permitting sensor 300 to communicate the encoded information of toner cartridge 100 to controller 28 of image forming device 22 via communications link 57. The encoded information may include, for example, authentication information such as a signature, serial number, or other identifier for authenticating or validating toner cartridge 100 upon installation of toner cartridge 100 in image forming device 22 or periodically during use of toner cartridge 100. The encoded information may include, for example, characteristics of toner cartridge 100 such as toner color, initial toner fill amount, toner type, geographic region, manufacture location, manufacture date, etc.

In the example embodiment illustrated, authentication information is encoded on encoded member 150 by randomly distributed magnetized particles 154 dispersed on disk 152, e.g., on the surface of disk 152 and/or within disk 152. Particles 154 are distributed randomly such that it is difficult to reproduce the exact distribution and alignment of particles 154 thereby making the distribution difficult to copy. In this embodiment, sensor 300 is positioned in close proximity to encoded member 150 when toner cartridge 100 is installed in image forming device 22, such as, adjacent to and facing the outboard side of disk 152 as schematically illustrated in FIG. 7. At predetermined times, such as upon the installation of a new toner cartridge in image forming device 22, sensor 300 measures the magnetic field of disk 152 in one, two or three orthogonal dimensions as disk 152 rotates due to rotation of input gear 142 by motor 70. The magnetic field values measured by sensor 300 are communicated to controller 28 via communications link 57. Controller 28 may then compare the magnetic field values received from sensor 300 to values stored during manufacture in non-volatile memory of processing circuitry 45 of toner cartridge 100. Controller 28 may confirm the authenticity of toner cartridge 100 to controller 28 if the magnetic field values received from sensor 300 match the values stored in non-volatile memory of processing circuitry 45.

While the example embodiment illustrated includes information encoded by a random distribution of magnetized particles and detection by measuring the magnetic field of the particles, it will be appreciated that information may be encoded by a random distribution of non-magnetized particles and detection may occur according to other means, such as, for example, by measuring an optical property of the particles. Further, in lieu of a random pattern, information may be encoded according to a predetermined pattern using any suitable indicia and detection method. However, as discussed above, it is preferred for authentication information to be encoded according to a random pattern so that encoded authentication information is more difficult for a counterfeiter to reproduce.

With reference to FIG. 6, in the example embodiment illustrated, at least a portion of encoded member 150 is exposed on the exterior of toner cartridge 100, e.g., above rotational axis 141 of input gear 142, for reading by sensor 300. For example, in the embodiment illustrated, encoded member 150 is exposed through a cutout 156 in end cap 112 that is positioned above rotational axis 141 of input gear 142. Although it is preferred for at least a portion of encoded member 150 to be exposed for reading by sensor 300 in order to ensure an accurate reading of encoded member 150, in other embodiments, encoded member 150 may be covered by a relatively thin material, e.g., in place of cutout 156, so long as sensor 300 is still able to accurately read encoded member 150 through the material.

Figure 8:
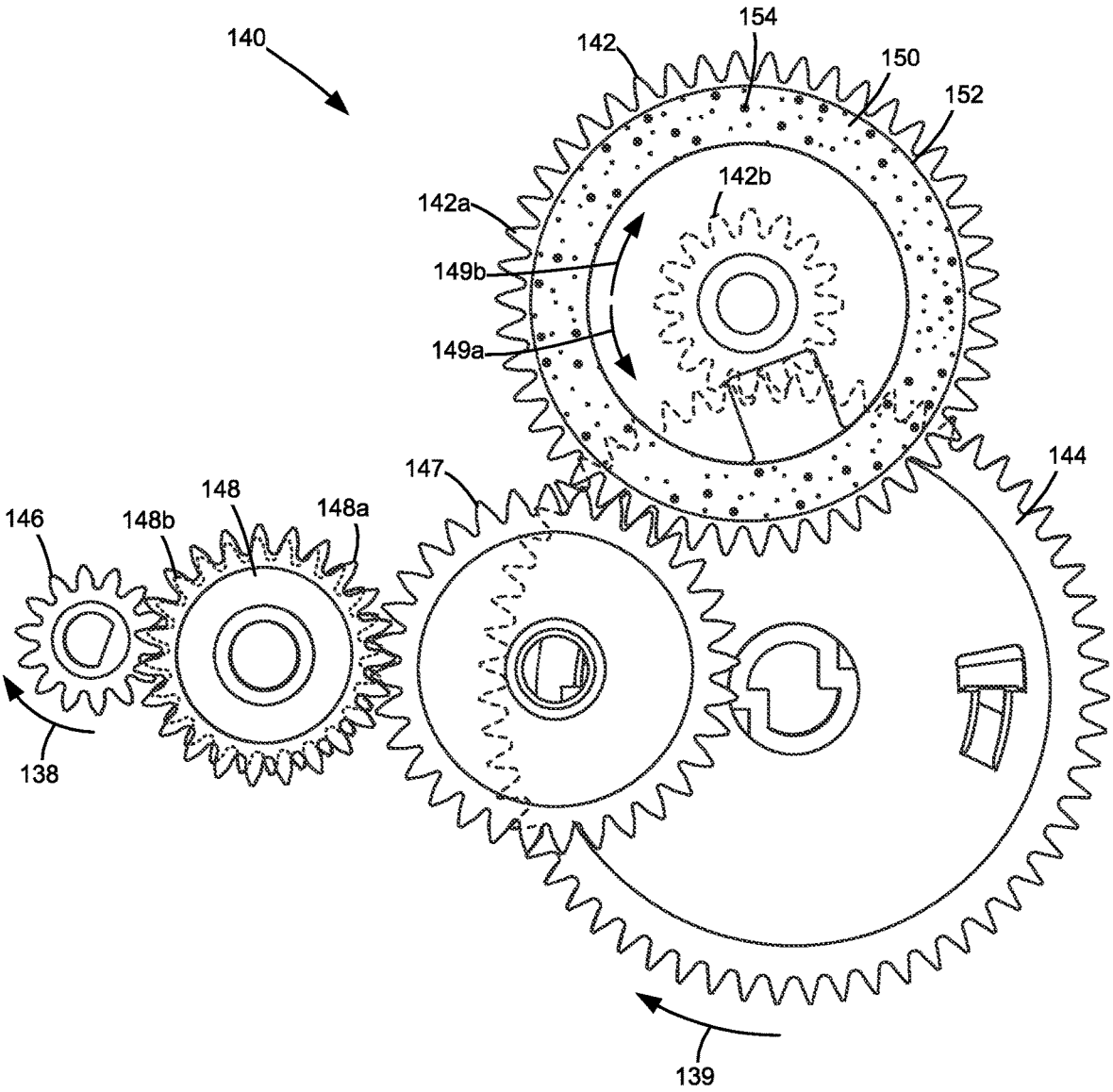
FIG. 8 is a side elevation view of a drive train of the toner cartridge according to one example embodiment.

FIG. 8 shows drive train 140 in greater detail according to one example embodiment. In the example embodiment illustrated, input gear 142 is a compound gear that includes a first portion 142*a* that mates with the corresponding output gear in image forming device 22 when toner cartridge 100 is installed in image forming device 22 and a second portion 142*b* that meshes with drive gear 144 in order to provide rotational motion to drive shaft 134. First portion 142*a* of input gear 142 also meshes with an idler gear 147 that, in turn, meshes with a compound idler gear 148. Compound idler gear 148 includes a first portion 148*a* that meshes with idler gear 147 and a second portion 148*b* that meshes with drive gear 146 in order to provide rotational motion to auger 132. It will be appreciated that the embodiment illustrated in FIG. 8 is merely an example and that drive train 140 may take many suitable configurations for transferring rotational motion from input gear 142 to toner agitator assembly 130 and to encoded member 150.

In some embodiments, in operation, controller 28 drives motor 70 in a first rotational direction to drive toner agitator assembly 130 and in a second rotational direction to perform a reading of encoded member 150 by sensor 300. In particular, when controller 28 drives motor 70 in the first rotational direction, input gear 142 rotates in a first rotational direction 149*a* and, in turn, rotates auger 132 and drive shaft 134 in operative rotational directions 138, 139 to feed toner from toner cartridge 100 to developer unit 202. When controller 28 drives motor 70 in the second rotational direction, input gear 142 rotates in a second rotational direction 149*b*. Sensor 300 is configured to read encoded member 150 as input gear 142 rotates in rotational direction 149*b*. In this manner, sensor 300 is able to perform a reading of encoded member 150 separately from a toner feed operation so that the authenticity or validity of toner cartridge 100 may be checked prior to the first use of toner cartridge 100 or at other times when toner cartridge 100 is not in use.

In some embodiments, toner agitator assembly 130 includes a one-way clutch that limits the rotational motion of at least one component of toner agitator assembly 130 to its operative rotational direction. For example, the one-way clutch may limit auger 132 and/or drive shaft 134 to its operative rotational direction 138, 139. For example, the one-way clutch may be operatively connected to drive gear 144 such that when input gear 142 rotates in rotational direction 149*a*, drive shaft 134 rotates in operative rotational direction 139 and when input gear 142 rotates in rotational direction 149*b*, drive shaft 134 is decoupled and does not rotate with input gear 142. In this manner, drive shaft 134 and toner agitators 136 do not rotate while sensor 300 performs a reading of encoded member 150. As a result, torque on drive shaft 134 and toner agitators 136 from toner stored in reservoir 104 does not affect the movement of encoded member 150 thereby permitting better control of encoded member 150 while sensor 300 performs a reading of encoded member 150 and improving the accuracy of the reading performed by sensor 300. Further, in some embodiments, toner agitators 136 may include flexible wipers that could displace or become damaged upon rotating counter to operative rotational direction 139. Decoupling drive shaft 134 from input gear 142 when input gear 142 rotates in rotational direction 149*b* prevents this from occurring.

With reference back to FIG. 6, toner cartridge 100 includes a vertical alignment guide 160 positioned on side 108 of housing 102, e.g., on an outer side of end cap 112. In the embodiment illustrated, alignment guide 160 is positioned axially outboard of input gear 142 and encoded member 150 relative to rotational axis 141. In this embodiment, alignment guide 160 is positioned below the portion of encoded member 150 exposed through cutout 156. Alignment guide 160 is positioned to contact a housing of sensor 300 when toner cartridge 100 is installed in image forming device 22 and to position sensor 300 vertically relative to encoded member 150 as discussed in greater detail below. Alignment guide 160 includes a top surface 162 that is unobstructed (i.e., by any other portion of toner cartridge 100) to contact a housing of sensor 300 from below in order to lift sensor 300 upward during insertion of toner cartridge 100 into image forming device 22 and in order to support the housing of sensor 300 from below when toner cartridge 100 is in its final installed position in image forming device 22 to maintain vertical alignment of sensor 300 with encoded member 150 during operation as discussed in greater detail below. In the embodiment illustrated, alignment guide 160 is formed as an extension outward sideways from side 108 of housing, such as away from an outer side of end cap 112. Top surface 162 includes a front portion 164 and a rear portion 166. In the embodiment illustrated, front portion 164 and rear portion 166 combine to form a continuous top surface 162. Front portion 164 of top surface 162 is positioned further forward (toward front 110 of housing 102) than rear portion 166 of top surface 162. That is, front portion 164 of top surface 162 is positioned closer to front 110 of housing 102 than rear portion 166 of top surface 162 is to front 110 of housing 102, and rear portion 166 of top surface 162 is positioned closer to rear 111 of housing 102 than front portion 164 of top surface 162 is to rear 111 of housing 102.

Front portion 164 of top surface 162 of alignment guide 160 inclines upward and rearward, toward top 106 and rear 111, such that front portion 164 of top surface 162 is positioned higher as it extends rearward toward rear 111 of housing 102. Front portion 164 of top surface 162 may include a planar surface (including one or multiple planar facets) that inclines upward and rearward, a curved surface (e.g., a convex surface as viewed from above) that inclines upward and rearward, or a combination thereof. As discussed in greater detail below, during insertion of toner cartridge 100 into image forming device 22, front portion 164 of top surface 162 contacts a housing of sensor 300 and lifts sensor 300 upward relative to toner cartridge 100 due to the incline of front portion 164 of top surface 162. Front portion 164 of top surface 162 leads rearward to rear portion 166 of top surface 162. In the embodiment illustrated, a portion of front portion 164 of top surface 162 extends lower than rear portion 166 of top surface 162.

As discussed in greater detail below, rear portion 166 of top surface 162 of alignment guide 160 contacts a housing of sensor 300 and sets the final vertical position of sensor 300 relative to toner cartridge 100 when toner cartridge 100 is in its final installed position in image forming device 22 in order to align sensor 300 vertically with disc 152 of encoded member 150 during operation of toner cartridge 100. In the example embodiment illustrated, rear portion 166 of top surface 162 is positioned higher than rotational axis 141 of input gear 142 and of disc 152, and at least a portion of rear portion 166 of top surface 162 extends rearward (toward rear 111 of housing 102) of rotational axis 141 of input gear 142 and of disc 152. However, rear portion 166 of top surface 162 may take other positions relative to rotational axis 141 depending on the location of the segment of encoded member 150 to be read by sensor 300.

Rear portion 166 of top surface 162 overlaps with outboard face 143 of input gear 142, including a portion of encoded member 150 on input gear 142 exposed through cutout 156, as viewed from side 108 of housing 102 (i.e., as viewed in FIG. 6) in order to permit sensor 300 to read encoded member 150 when a housing of sensor 300 is in contact with rear portion 166 of top surface 162. In the embodiment illustrated, cutout 156 extends upward from rear portion 166 of top surface 162 such that a portion of encoded member 150 is exposed directly above rear portion 166 of top surface 162 for reading by sensor 300. In the example embodiment illustrated, rear portion 166 of top surface 162 is positioned lower than a topmost portion of the gear teeth of input gear 142 and lower than at least a portion of the magnetized particles 154 on disc 152 of encoded member 150 in order to permit sensor 300 to read encoded member 150 when a housing of sensor 300 is in contact with rear portion 166 of top surface 162. In the embodiment illustrated, rear portion 166 of top surface 162 is positioned immediately adjacent to encoded member 150, e.g., spaced a few millimeters along an axial dimension of input gear 142 from encoded member 150, in order to permit sensor 300 to be positioned in close proximity to encoded member 150 when toner cartridge 100 is installed in image forming device 22.

In some embodiments, rear portion 166 of top surface 162 is formed by a planar portion of top surface 162. In the example embodiment illustrated, rear portion 166 of top surface 162 is parallel to a bottom contact surface 125 of positioning guide 124 on side 108 of toner cartridge 100. When toner cartridge 100 is installed in image forming device 22, bottom contact surface 125 of positioning guide 124 contacts a top surface of a corresponding guide rail in image forming device 22 to define the vertical position of toner cartridge 100 relative to image forming device 22. In the embodiment illustrated, bottom contact surface 125 of positioning guide 124 is defined by a pair of rounded bottom contact surfaces 125*a*, 125*b* that extend downward in a convex manner from the rest of positioning guide 124. As shown in FIG. 6, an imaginary line 125*c* formed by the bottommost points of rounded bottom contact surfaces 125*a*, 125*b* of positioning guide 124 on side 108 of housing 102 is parallel to rear portion 166 of top surface 162 as depicted by imaginary line 168.

In some embodiments, toner cartridge 100 also includes a rear stop 170 positioned on side 108 of housing 102, e.g., on an outer side of end cap 112. Stop 170 is positioned at a rear end of alignment guide 160. Stop 170 includes a frontward facing surface 172 that faces toward front 110 of housing 102. Frontward facing surface 172 may include, for example, a vertical or primarily vertical surface. Frontward facing surface 172 is unobstructed (i.e., by any other portion of toner cartridge 100) to contact the housing of sensor 300 in order to limit the position of sensor 300 in a direction from front 110 toward rear 111 along front-to-rear dimension 126 when toner cartridge 100 is in its final installed position in image forming device 22 in order to ensure that sensor 300 is aligned with encoded member 150 along front-to-rear dimension 126. In the example embodiment illustrated, frontward facing surface 172 extends upward from a rear end of rear portion 166 of top surface 162 of alignment guide 160, and frontward facing surface 172 is spaced rearward (toward rear 111 of housing 102) from rotational axis 141 of input gear 142 and of disc 152.

Figure 9:
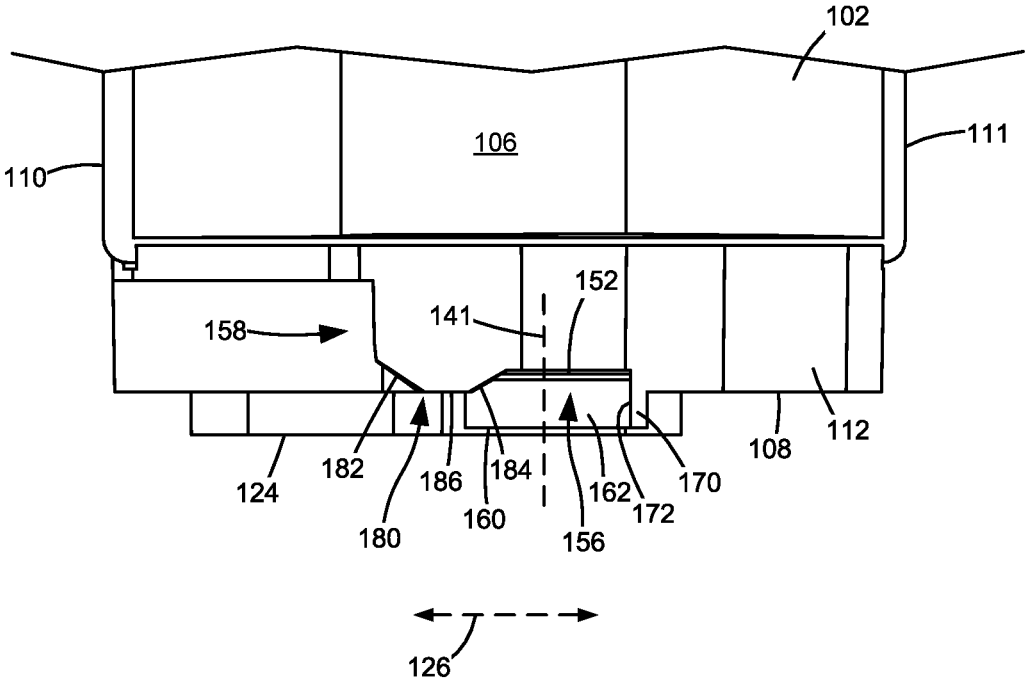
FIG. 9 is a top plan view of a portion of the toner cartridge shown in FIGS. 2-6 according to one example embodiment.

With reference to FIGS. 6 and 9, in the example embodiment illustrated, toner cartridge 100 includes an axial alignment guide 180 positioned on side 108 of housing 102, e.g., on an outer side of end cap 112. As discussed in greater detail below, alignment guide 180 is positioned to contact a housing of sensor 300 during insertion of toner cartridge 100 into image forming device 22 and to move the housing of sensor 300 axially relative to rotational axis 141 in order to ensure that the housing of sensor 300 clears front edges of input gear 142 and disc 152 and to guide the housing of sensor 300 to cutout 156 for reading encoded member 150. In the embodiment illustrated, alignment guide 180 is positioned directly in front of cutout 156, closer to front 110 of housing 102 than cutout 156 is to front 110 of housing 102. Alignment guide 180 leads rearward along side 108 of housing 102 toward the portion of encoded member 150 exposed through cutout 156.

Alignment guide 180 includes a first guide surface 182 and a second guide surface 184 that is positioned rearward of first guide surface 182. That is, first guide surface 182 is positioned closer to front 110 of housing 102 than second guide surface 184 is to front 110 of housing 102, and second guide surface 184 is positioned closer to rear 111 of housing 102 than first guide surface 182 is to rear 111 of housing 102. First guide surface 182 inclines outward sideways and rearward, away from side 108 of housing 102 and toward rear 111 of housing 102, such that first guide surface 182 is positioned further outward sideways as it extends rearward toward rear 111 of housing 102. First guide surface 182 may include a planar surface (including one or multiple planar facets) that inclines outward sideways and rearward, a curved surface that inclines outward sideways and rearward, or a combination thereof. Second guide surface 184 inclines inward sideways and rearward, toward reservoir 104 and opposite side 109 of housing 102 and toward rear 111 of housing 102, such that second guide surface 184 is positioned further inward sideways as it extends rearward toward rear 111 of housing 102. Second guide surface 184 may include a planar surface (including one or multiple planar facets) that inclines inward sideways and rearward, a curved surface that inclines inward sideways and rearward, or a combination thereof.

In the embodiment illustrated, a third guide surface 186 is positioned between first guide surface 182 and second guide surface 184 along front-to-rear dimension 126. In this embodiment, first guide surface 182 leads rearward to third guide surface 186, and third guide surface 186 leads rearward to second guide surface 184. Third guide surface 186 has a substantially constant position along an axial dimension of rotational axis 141. That is, in the embodiment illustrated, third guide surface 186 does not angle or incline inward sideways or outward sideways as it extends frontward or rearward. In other embodiments, first guide surface 182 leads directly to second guide surface 184 as desired. Guide surfaces 182, 184, 186 are unobstructed (i.e., by any other portion of toner cartridge 100) to contact the housing of sensor 300 during insertion of toner cartridge 100 into image forming device 22 and to move the housing of sensor 300 axially relative to rotational axis 141 during insertion of toner cartridge 100 into image forming device 22.

In the embodiment illustrated, at least a portion of each of first, second and third guide surfaces 182, 184, 186 of alignment guide 180 is positioned higher than rotational axis 141 and higher than top surface 162 of vertical alignment guide 160. In the embodiment illustrated, first and third guide surfaces 182, 186 are spaced forward, toward front 110 of housing 102, from rotational axis 141. In this manner, each of first and third guide surfaces 182, 186 is positioned closer to front 110 of housing 102 than rotational axis 141 is to front 110 of housing 102. Further, at least a portion of second guide surface 184, such as a point where second guide surface 184 begins to angle inward sideways and rearward, is spaced forward, toward front 110 of housing 102, from rotational axis 141, i.e., closer to front 110 of housing 102 than rotational axis 141 is to front 110 of housing 102. The positioning of guide surfaces 182, 184, 186 allows alignment guide 180 to contact the housing of sensor 300 during insertion of toner cartridge 100 into image forming device 22 prior to sensor 300 reaching cutout 156 or encoded member 150 in order to ensure that the housing of sensor 300 clears front edges of input gear 142 and disc 152 and to guide the housing of sensor 300 to cutout 156 for reading encoded member 150.

With reference to FIG. 9, in the embodiment illustrated, at least a portion of each of first and second guide surfaces 182, 184 extends further outward sideways from side 108 of housing 102 than input gear 142 and disc 152 of encoded member 150 extend from side 108 of housing 102 in order to ensure that the housing of sensor 300 clears front edges of input gear 142 and disc 152 during insertion of toner cartridge 100 into image forming device 22. Third guide surface 186 is also positioned further outward sideways relative to side 108 of housing 102 than input gear 142 and disc 152 of encoded member 150 extend from side 108 of housing 102. In the embodiment illustrated, disc 152 of encoded member 150 extends further outward sideways from side 108 of housing 102 than an innermost axial (relative to rotational axis 141) portion of each of first and second guide surfaces 182, 184 in order to permit the housing of sensor 300 to directly contact disc 152 of encoded member 150 when toner cartridge 100 is in its final installed position in image forming device 22 and sensor 300 is aligned with cutout 156.

Figure 10:
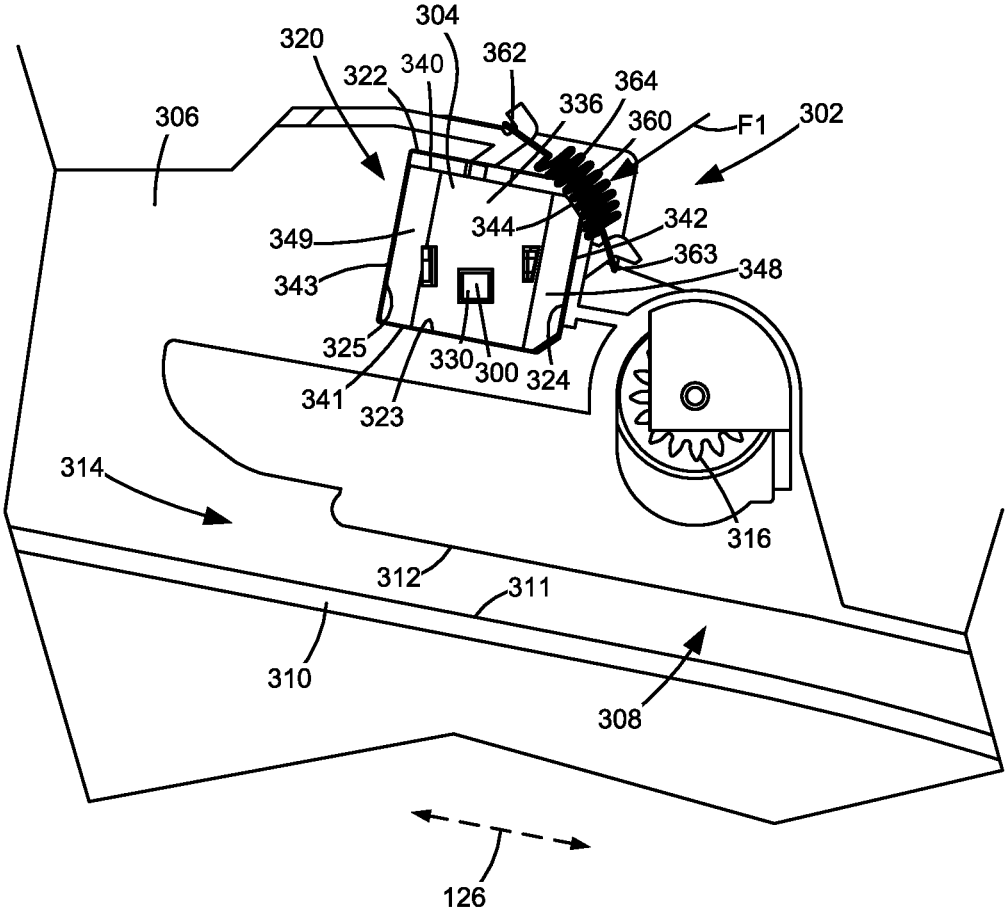
FIG. 10 is a side elevation view of a sensor assembly of an image forming device according to one example embodiment.
Figure 11:
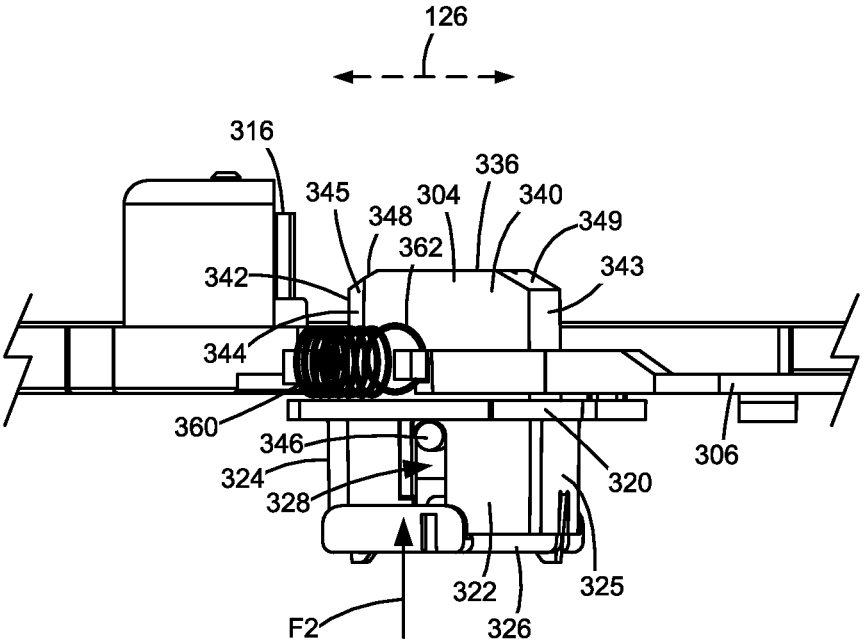
FIG. 11 is a top plan view of the sensor assembly shown in FIG. 10.
Figure 12:
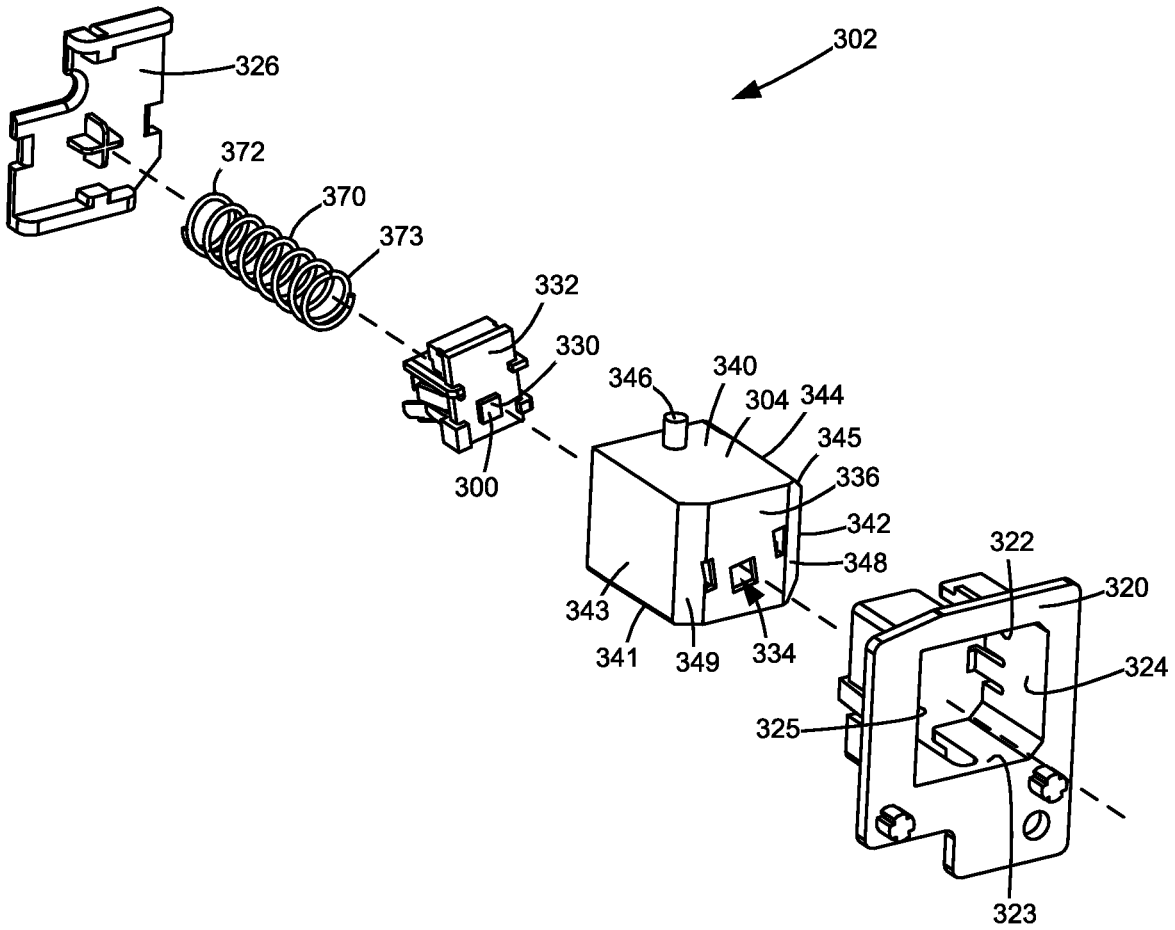
FIG. 12 is an exploded view of the sensor assembly shown in FIGS. 10 and 11.

With reference to FIGS. 10-12, a sensor assembly 302 of image forming device 22 is shown according to one example embodiment. Sensor assembly 302 includes sensor 300 mounted to a sensor housing 304. Sensor housing 304 is, in turn, mounted to a portion of a frame 306 of image forming device 22. Frame 306 runs along front-to-rear dimension 126 of toner cartridge 100 when toner cartridge 100 is installed in image forming device 22. Frame 306 is positioned in close proximity with and generally faces side 108 of toner cartridge 100 when toner cartridge 100 is installed in image forming device 22. Frame 306 includes a guide slot 308 formed therein that receives positioning guide 124 on side 108 of toner cartridge 100 during insertion of toner cartridge 100 into image forming device 22. Guide slot 308 is defined by a gap formed between a bottom guide rail 310 and a top guide rail 312. A top surface 311 of bottom guide rail 310 contacts bottom contact surface 125 of positioning guide 124 on side 108 of toner cartridge 100 when toner cartridge 100 is installed in image forming device 22 to define the vertical position of toner cartridge 100 at side 108 relative to image forming device 22. Guide slot 308 extends primarily along front-to-rear dimension 126 of toner cartridge 100. A rear end 314 of guide slot 308 shown in FIG. 10 is positioned proximate to rear 111 of toner cartridge 100 when toner cartridge 100 is installed in image forming device.

An output gear 316 is exposed on a portion of frame 306 above top guide rail 312 in the embodiment illustrated. Output gear 316 is operatively connected to motor 70 in image forming device 22 and mates with corresponding input gear 142 of toner cartridge 100 when toner cartridge 100 is installed in image forming device 22 in order to provide rotational motion to input gear 142.

Frame 306 also includes a sensor mount 320 that is positioned above top guide rail 312 in the embodiment illustrated. Sensor housing 304 is mounted to sensor mount 320 of frame 306 in a manner that permits sensor housing 304 to move relative to frame 306. Sensor mount 320 includes a top guide wall 322, a bottom guide wall 323, a front guide wall 324 and a rear guide wall 325 that aid in positioning sensor housing 304 vertically and along front-to-rear dimension 126 of toner cartridge 100 relative to frame 306. Sensor mount 320 also includes an end wall 326 that aids in positioning sensor housing 304 axially relative to rotational axis 141 of toner cartridge 100 relative to frame 306.

In the example embodiment illustrated, sensor 300 includes one or more hall-effect sensors 330 mounted on a printed circuit board 332. Hall-effect sensor(s) 330 are configured to measure the magnetic field of magnetized particles 154 on disc 152 of encoded member 150 in one, two or three orthogonal dimensions as disc 152 rotates. Printed circuit board 332 facilitates communication of the magnetic field measurements obtained by hall-effect sensor (s) 330 to controller 28 of image forming device 22 by way of communications path 57. Printed circuit board 332 having sensor 300 is fixedly mounted to sensor housing 304. In the embodiment illustrated, a portion of sensor 300 is exposed through a cutout 334 on an outer face 336 of sensor housing 304 to permit an unobstructed reading of the magnetic field of magnetized particles 154 of encoded member 150 by sensor 300. Outer face 336 of sensor housing 304 is positioned at an innermost end of sensor housing 304 along rotational axis 141 of toner cartridge 100 (nearest toner cartridge 100) and faces toward side 108 of toner cartridge 100.

With reference to FIG. 10, sensor housing 304 includes a top 340, a bottom 341, a front side 342 and a rear side 343 that are positioned in close proximity to inside surfaces of top guide wall 322, bottom guide wall 323, front guide wall 324 and rear guide wall 325, respectively. In the embodiment illustrated, sensor housing 304 and sensor mount 320 are sized to permit vertical movement of sensor housing 304 relative to sensor mount 320 of frame 306. Upward movement of sensor housing 304 relative to frame 306 is limited by contact between top 340 of sensor housing 304 and top guide wall 322 of sensor mount 320, and downward movement of sensor housing 304 relative to frame 306 is limited by contact between bottom 341 of sensor housing 304 and bottom guide wall 323 of sensor mount 320. In the embodiment illustrated, sensor housing 304 and sensor mount 320 are sized to limit lateral movement along front-to-rear dimension 126 of toner cartridge 100 in comparison with the amount of vertical movement permitted. Forward lateral movement of sensor housing 304 along front-to-rear dimension 126 relative to frame 306 is limited by contact between front side 342 of sensor housing 304 and front guide wall 324 of sensor mount 320, and rearward lateral movement of sensor housing 304 along front-to-rear dimension 126 relative to frame 306 is limited by contact between rear side 343 of sensor housing 304 and rear guide wall 325 of sensor mount 320.

In the example embodiment illustrated, sensor housing 304 is biased by one or more springs downward and rearward along front-to-rear dimension 126, i.e., toward bottom guide wall 323 and rear guide wall 325 of sensor mount 320. In the embodiment illustrated, an extension spring 360 biases sensor housing 304 downward and rearward along front-to-rear dimension 126. A first end 362 of extension spring 360 is anchored to top guide wall 322, and a second end 363 of extension spring 360 is anchored to front guide wall 324. A corner 344 of sensor housing 304 formed at an intersection of top 340 and front side 342 contacts a coil portion 364 of extension spring 360 that is intermediate ends 362, 363 and displaces coil portion 364 from its natural position along a straight line between ends 362, 363 causing coil portion 364 to bend around corner 344 of sensor housing 304. The bending of coil portion 364 of extension spring 360 around corner 344 of sensor housing 304 causes coil portion 364 to remain in constant contact with corner 344 of sensor housing 304 and to apply a bias force on corner 344 of sensor housing 304 that urges sensor housing 304 downward and rearward as indicated by the arrow F1 in FIG. 10. Corner 344 may include a chamfered surface 345 that provides a contact surface that is less likely to catch or snag on coil portion 364 of extension spring 360.

With reference to FIGS. 11 and 12, in the embodiment illustrated, sensor housing 304 and sensor mount 320 are sized to permit axial movement of sensor housing 304 relative to sensor mount 320 of frame 306 along rotational axis 141 of toner cartridge 100. In the embodiment illustrated, a vertical post 346 extends upward from top 340 of sensor housing 304. Post 346 is received by an elongated slot 328 formed in top guide wall 322 of sensor mount 320. Slot 328 is elongated axially relative to rotational axis 141 permitting post 346 to move axially within slot 328 relative to rotational axis 141. Although not shown, in the example embodiment illustrated, bottom 341 of sensor housing 304 includes a post substantially identical to post 346 and bottom guide wall 323 of sensor mount 320 includes an elongated slot substantially identical to elongated slot 328. The relationship between the posts of sensor housing 304 and the elongated slots of sensor mount 320 permit sensor housing 304 to move relative to frame 306 axially along rotational axis 141, toward and away from side 108 of toner cartridge 100. It will be appreciated that the post/slot interface of sensor housing 304 and sensor mount 320 may be reversed to instead include one or more guide posts on sensor mount 320 and one or more corresponding elongated guide slots in sensor housing 304 as desired to permit movement of sensor housing 304 relative to frame 306 axially along rotational axis 141 of toner cartridge 100.

In the example embodiment illustrated, sensor housing 304 is biased by one or more springs outward from frame 306 (toward side 108 of toner cartridge 100) along rotational axis 141, away from end wall 326 of sensor mount 320. In the embodiment illustrated, a compression spring 370 biases sensor housing 304 outward from frame 306 (toward side 108 of toner cartridge 100) along rotational axis 141. A first end 372 of compression spring 370 is positioned against end wall 326 of sensor mount 320, and a second end 373 of compression spring 370 is positioned against a surface of sensor housing 304 and/or printed circuit board 332 that faces end wall 326. Compression spring 370 applies a bias force on sensor housing 304 that urges sensor housing 304 outward from frame 306 (toward side 108 of toner cartridge 100) as indicated by the arrow F2 in FIG. 11. The force applied by compression spring 370 urges the posts of sensor housing 304 toward the innermost ends (nearest toner cartridge 100) of the elongated slots of sensor mount 320 in the embodiment illustrated.

In the embodiment illustrated, sensor housing 304 includes first and second chamfered surfaces 348, 349 that facilitate smooth contact between sensor housing 304 and axial alignment guide 180 of toner cartridge 100 during insertion of toner cartridge 100 into image forming device 22 as discussed in greater detail below. First chamfered surface 348 is formed at an intersection of outer face 336 with front side 342 of sensor housing 304. Second chamfered surface 349 is formed at an intersection of outer face 336 with rear side 343 of sensor housing 304. In the embodiment illustrated, each chamfered surface 348, 349 is formed as a planar facet that is angled from outer face 336 toward the respective front side 342 and rear side 343 of sensor housing 304. As desired, rounded surfaces may be used at the intersections of outer face 336 with front side 342 and rear side 343 of sensor housing 304 in place of the planar surfaces illustrated.

Figure 13:
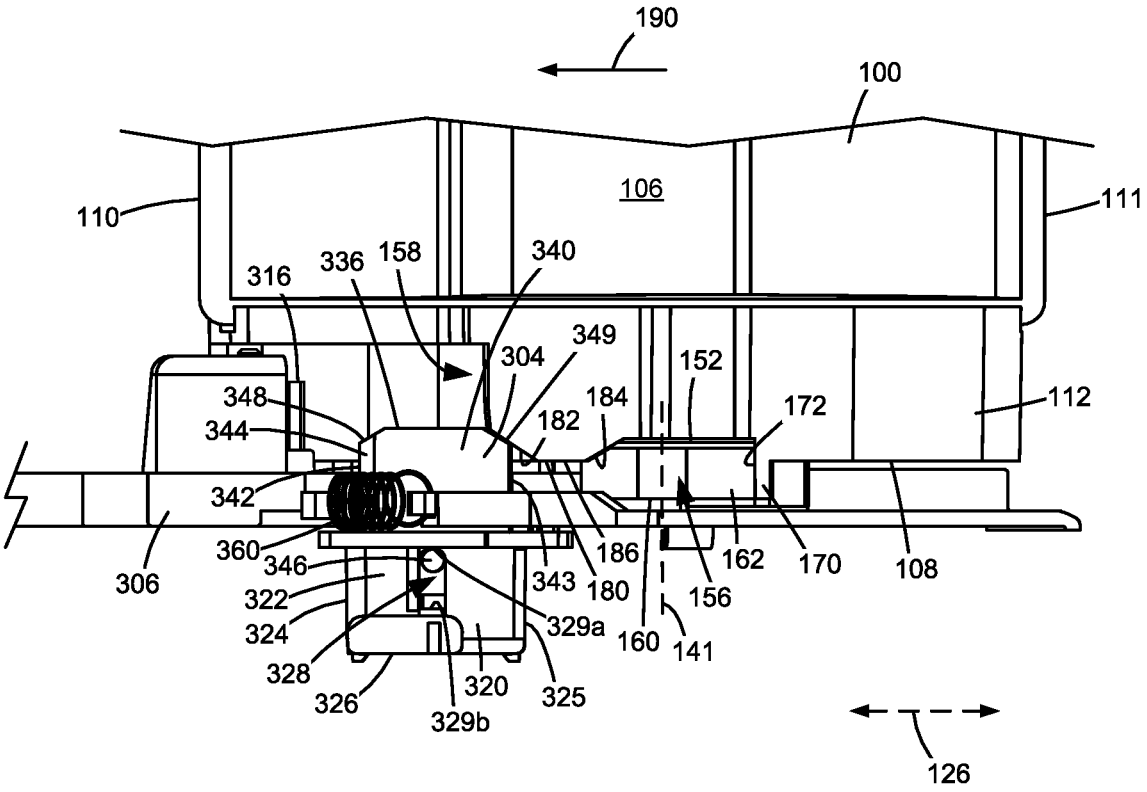
FIG. 13 is a top plan view showing the position of the toner cartridge relative to the sensor assembly as the toner cartridge enters the image forming device according to one example embodiment.

FIGS. 13-18B sequentially illustrate the interaction between sensor housing 304 in image forming device 22 and the corresponding alignment guides on toner cartridge 100 during insertion of toner cartridge 100 into image forming device 22. FIG. 13 is a top plan view showing the position of toner cartridge 100 relative to frame 306 as toner cartridge 100 enters image forming device 22 when a front end of positioning guide 124 on side 108 of toner cartridge 100 enters guide slot 310 on frame 306. Arrow 190 indicates the direction of insertion of toner cartridge 100 into image forming device 22 with front 110 of toner cartridge 100 leading. FIG. 13 shows first guide surface 182 of axial alignment guide 180 of toner cartridge 100 approaching chamfered surface 349 of sensor housing 304 as toner cartridge 100 advances in direction of insertion 190. Prior to contact between axial alignment guide 180 of toner cartridge 100 and sensor housing 304, sensor housing 304 is fully extended outward along rotational axis 141, toward side 108 of toner cartridge 100 as a result of the bias applied by compression spring 370 with post 346 of sensor housing 304 in contact with an innermost end 329*a* (nearest toner cartridge 100) of elongated slot 328.

Figure 14:
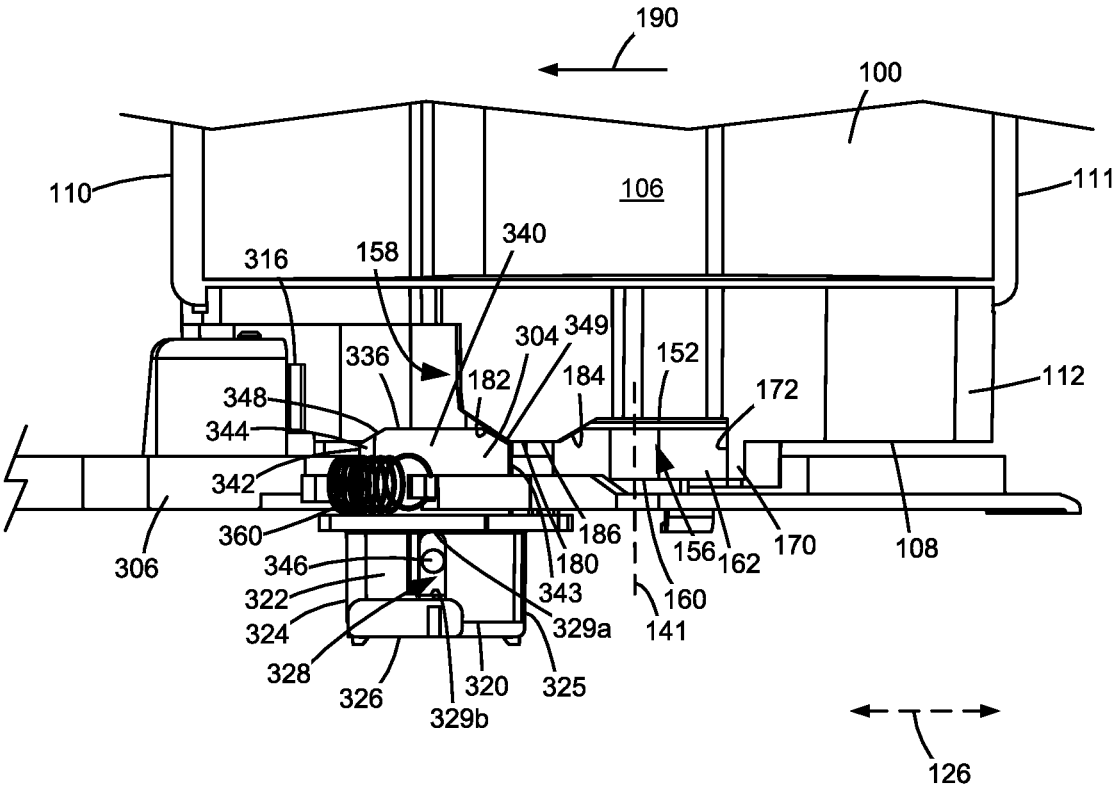
FIG. 14 is a top plan view showing the position of the toner cartridge relative to the sensor assembly with the toner cartridge advanced further into the image forming device from the position shown in FIG. 13 showing an axial alignment guide of the toner cartridge contacting a sensor housing of the sensor assembly.

FIG. 14 is a top plan view showing the position of toner cartridge 100 relative to frame 306 with toner cartridge 100 advanced along direction of insertion 190 from the position shown in FIG. 13. As toner cartridge 100 advances further into image forming device 22 along direction of insertion 190, first guide surface 182 of axial alignment guide 180 of toner cartridge 100 contacts chamfered surface 349 of sensor housing 304. The force applied to chamfered surface 349 of sensor housing 304 by first guide surface 182 of axial alignment guide 180 as toner cartridge 100 advances overcomes the bias force applied to sensor housing 304 by compression spring 370 causing sensor housing 304 to retract along rotational axis 141, toward frame 306 and away from side 108 of toner cartridge 100, as a result of the angle of first guide surface 182. When sensor housing 304 retracts, toward frame 306 and away from side 108 of toner cartridge 100, post 346 of sensor housing 304 moves away from innermost end 329*a* of elongated slot 328 and toward outermost end 329*b* of elongated slot 328 as shown in FIG. 14.

Figure 15A:
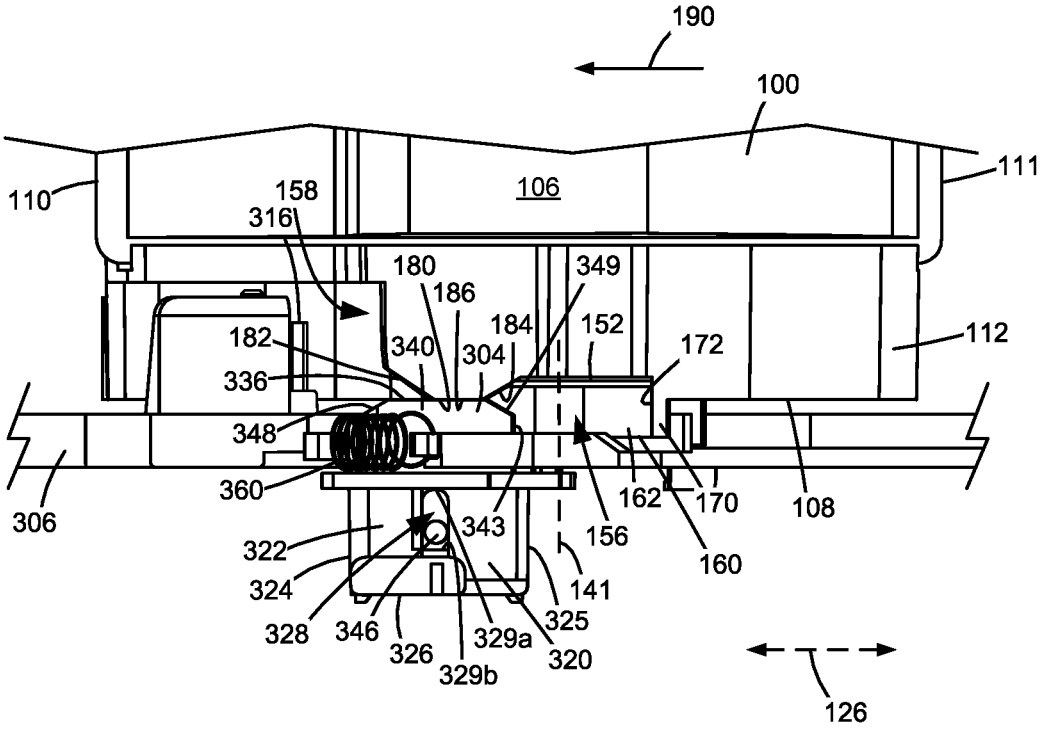
FIGS. 15A and 15B are a top plan view and a side elevation view, respectively, showing the position of the toner cartridge relative to the sensor assembly with the toner cartridge advanced further into the image forming device from the position shown in FIG. 14.
Figure 15B:
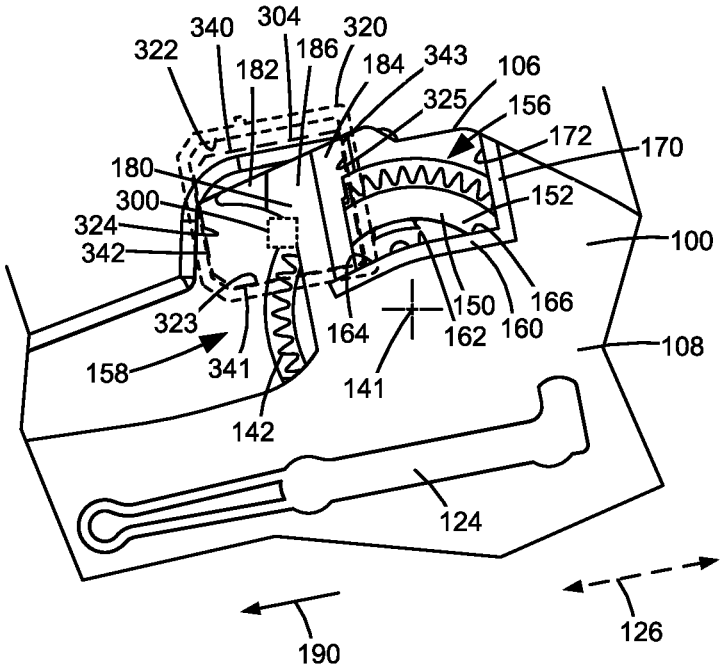

FIGS. 15A and 15B are a top plan view and a side elevation view, respectively, showing the position of toner cartridge 100 relative to frame 306 with toner cartridge 100 advanced along direction of insertion 190 from the position shown in FIG. 14. FIG. 15B shows the positions of sensor 300, sensor housing 304 and sensor mount 320 relative to side 108 of toner cartridge 100 illustrated schematically in dashed line in order to avoid obscuring the features of toner cartridge 100. As shown in FIG. 15A, as toner cartridge 100 advances further into image forming device 22 along direction of insertion 190, first guide surface 182 of axial alignment guide 180 of toner cartridge 100 clears and passes chamfered surface 349 of sensor housing 304, and third guide surface 186 of axial alignment guide 180 of toner cartridge 100 contacts outer face 336 of sensor housing 304. Contact between third guide surface 186 of axial alignment guide 180 and outer face 336 of sensor housing 304 maintains a substantially constant retracted axial position of sensor housing 304 relative to rotational axis 141 as toner cartridge 100 continues to advance as a result of the substantially constant position of third guide surface 186 along the axial dimension of rotational axis 141. FIG. 15B shows front portion 164 of top surface 162 of vertical alignment guide 160 approaching bottom 341 of sensor housing 304. Prior to contact between vertical alignment guide 160 of toner cartridge 100 and sensor housing 304, sensor housing 304 is in its lowest vertical position as a result of the bias applied by extension spring 360 with bottom 341 of sensor housing 304 in contact with bottom guide wall 323 of sensor mount 320.

Figure 16A:
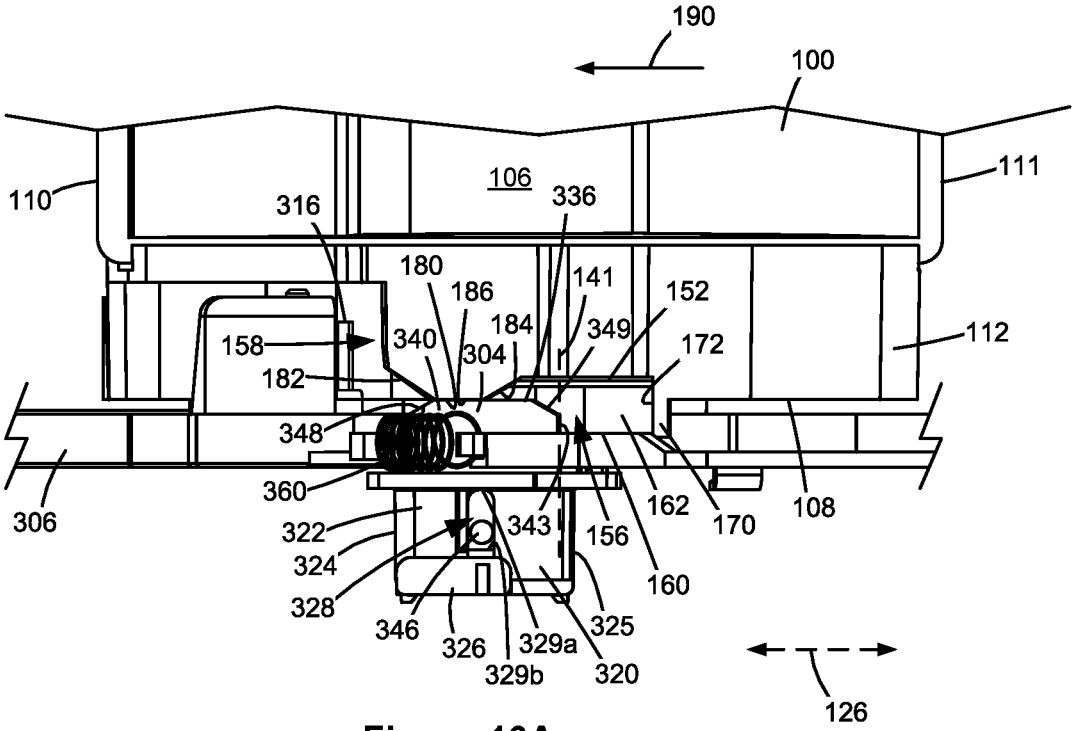
FIGS. 16A and 16B are a top plan view and a side elevation view, respectively, showing the position of the toner cartridge relative to the sensor assembly with the toner cartridge advanced further into the image forming device from the position shown in FIGS. 15A and 15B showing a vertical alignment guide of the toner cartridge contacting the sensor housing of the sensor assembly.
Figure 16B:
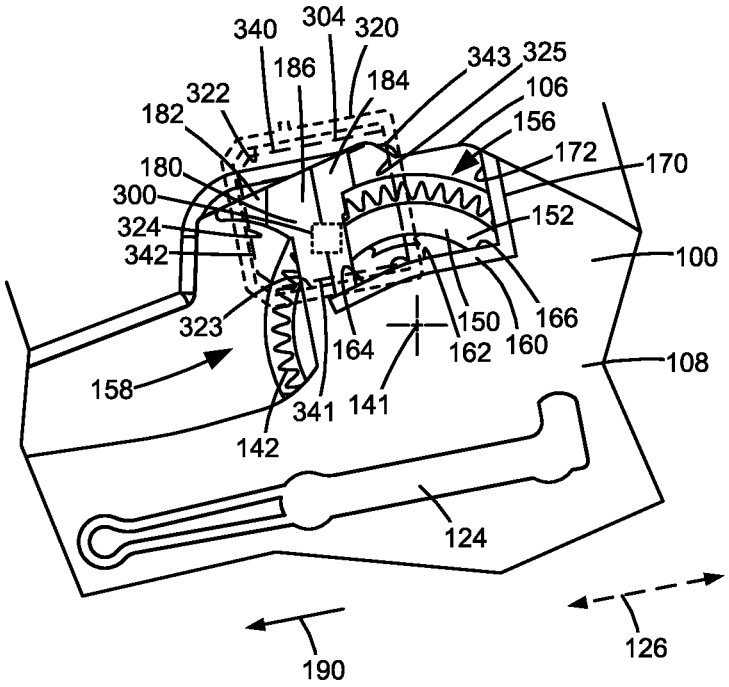

FIGS. 16A and 16B are a top plan view and a side elevation view, respectively, showing the position of toner cartridge 100 relative to frame 306 with toner cartridge 100 advanced along direction of insertion 190 from the position shown in FIGS. 15A and 15B. As shown in FIG. 16A, as toner cartridge 100 advances further into image forming device 22 along direction of insertion 190, third guide surface 186 of axial alignment guide 180 of toner cartridge 100 maintains contact with and slides across outer face 336 of sensor housing 304 maintaining the retracted axial position of sensor housing 304 relative to rotational axis 141. As shown in FIG. 16B, as toner cartridge 100 advances further into image forming device 22 along direction of insertion 190, front portion 164 of top surface 162 of vertical alignment guide 160 of toner cartridge 100 contacts bottom 341 of sensor housing 304. The force applied to bottom 341 of sensor housing 304 by front portion 164 of top surface 162 of vertical alignment guide 160 as toner cartridge 100 advances overcomes the bias force applied to sensor housing 304 by extension spring 360 causing sensor housing 304 to lift upward as a result of the angle of front portion 164 of top surface 162. When sensor housing 304 lifts upward, bottom 341 of sensor housing 304 lifts upward away from bottom guide wall 323 of sensor mount 320 as shown in FIG. 16B.

Figure 17A:
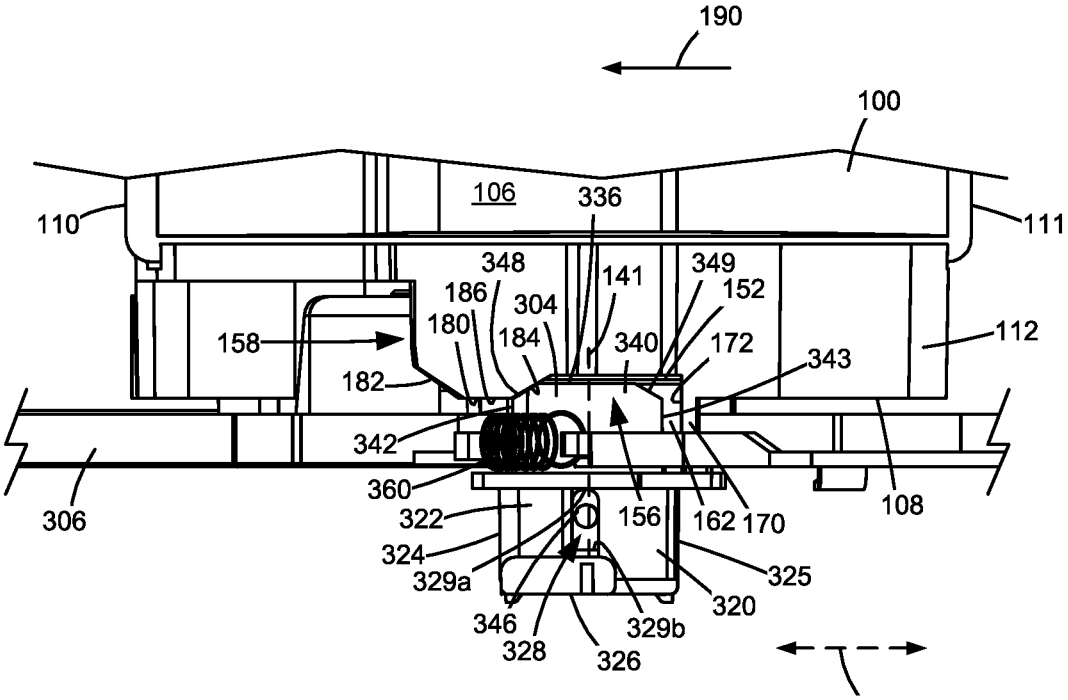
FIGS. 17A and 17B are a top plan view and a side elevation view, respectively, showing the position of the toner cartridge relative to the sensor assembly with the toner cartridge advanced further into the image forming device from the position shown in FIGS. 16A and 16B.
Figure 17B:
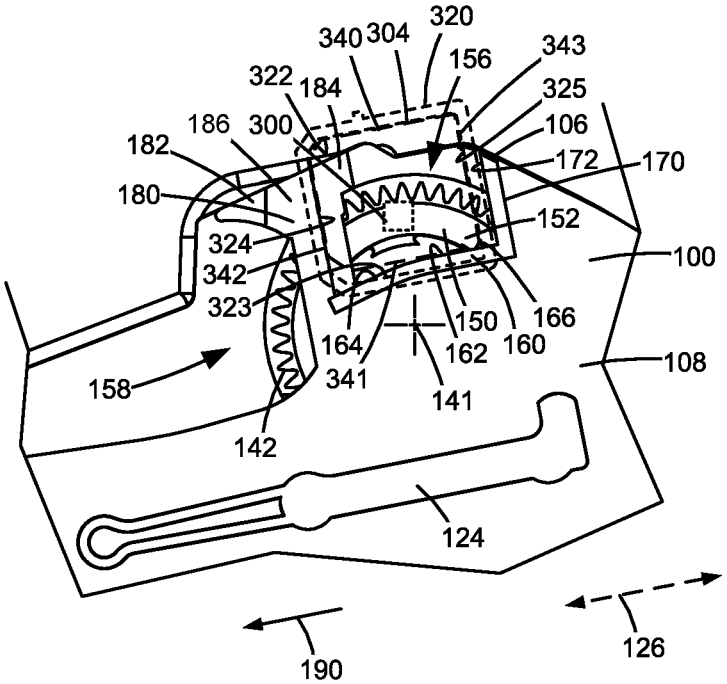

FIGS. 17A and 17B are a top plan view and a side elevation view, respectively, showing the position of toner cartridge 100 relative to frame 306 with toner cartridge 100 advanced along direction of insertion 190 from the position shown in FIGS. 16A and 16B. As shown in FIG. 17A, as toner cartridge 100 advances further into image forming device 22 along direction of insertion 190, third guide surface 186 of axial alignment guide 180 of toner cartridge 100 clears and passes outer face 336 of sensor housing 304, and second guide surface 184 of axial alignment guide 180 of toner cartridge 100 contacts chamfered surface 348 of sensor housing 304. As toner cartridge 100 continues to advance along direction of insertion 190, the bias force applied to sensor housing 304 by compression spring 370 causes sensor housing 304 to gradually extend along rotational axis 141, away from frame 306 and toward side 108 of toner cartridge 100 as limited by contact between chamfered surface 348 of sensor housing 304 and second guide surface 184 of axial alignment guide 180 due to the angle of second guide surface 184. When sensor housing 304 extends, away from frame 306 and toward side 108 of toner cartridge 100, post 346 of sensor housing 304 moves back toward innermost end 329*a* of elongated slot 328 and away from outermost end 329*b* of elongated slot 328 as shown in FIG. 17A. As shown in FIG. 17B, as toner cartridge 100 advances further into image forming device 22 along direction of insertion 190, rear portion 166 of top surface 162 of vertical alignment guide 160 of toner cartridge 100 contacts bottom 341 of sensor housing 304. Contact between rear portion 166 of top surface 162 of vertical alignment guide 160 of toner cartridge 100 and bottom 341 of sensor housing 304 sets the final vertical position of sensor housing 304 relative to toner cartridge 100 in order to align sensor 300 vertically with the portion of disc 152 of encoded member 150 exposed in cutout 156 to be read by sensor 300.

Figure 18A:
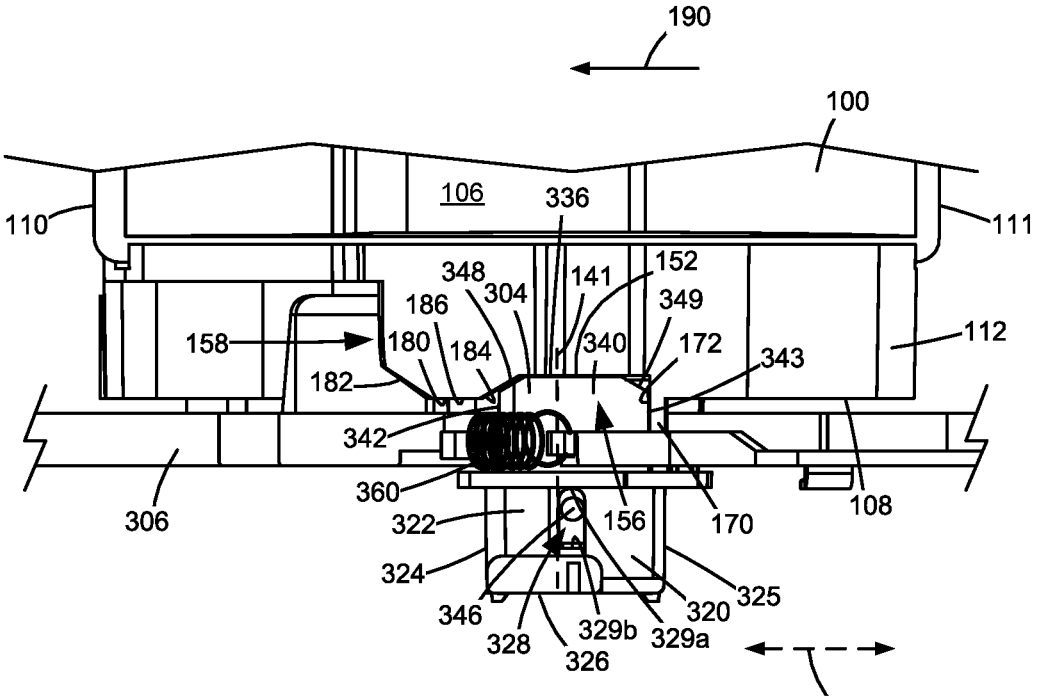
FIGS. 18A and 18B are a top plan view and a side elevation view, respectively, showing the position of the toner cartridge relative to the sensor assembly with the toner cartridge in its final installed position in the image forming device.
Figure 18B:
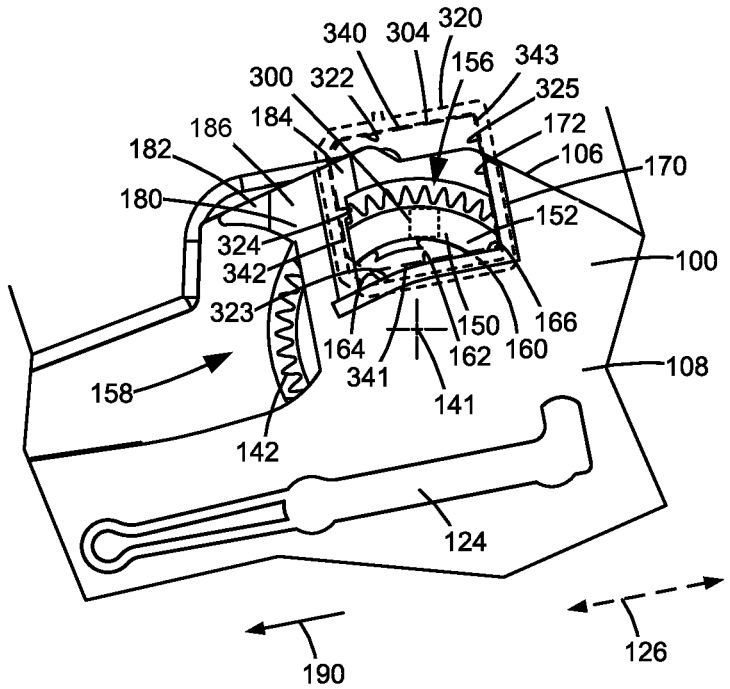

FIGS. 18A and 18B are a top plan view and a side elevation view, respectively, showing the final position of toner cartridge 100 relative to frame 306 when toner cartridge 100 is in its final installed position in image forming device 22. As shown in FIG. 18A, as toner cartridge 100 advances further into image forming device 22 along direction of insertion 190 toward the final installed position of toner cartridge 100 in image forming device 22, second guide surface 184 of axial alignment guide 180 of toner cartridge 100 clears chamfered surface 348 of sensor housing 304, and sensor housing 304 reaches its final axial position along rotational axis 141 relative to toner cartridge 100 in order to set the axial distance from sensor 300 to disc 152 of encoded member 150. In the example embodiment illustrated, contact between outer face 336 of sensor housing 304 and disc 152 sets the final axial position of sensor housing 304 relative to toner cartridge 100. In other embodiments, contact between outer face 336 of sensor housing 304 and a portion of housing 102, such as a portion of the outer side of end cap 112 positioned above cutout 156, sets the final axial position of sensor housing 304 relative to toner cartridge 100. As shown in FIG. 18B, as toner cartridge 100 advances further into image forming device 22 along direction of insertion 190 toward the final installed position of toner cartridge 100 in image forming device 22, rear portion 166 of top surface 162 of vertical alignment guide 160 of toner cartridge 100 maintains contact with and slides across bottom 341 of sensor housing 304 maintaining the final vertical position of sensor housing 304 relative to toner cartridge 100. In the embodiment illustrated, forward facing surface 172 of rear stop 170 contacts rear side 343 of sensor housing 304 when toner cartridge 100 is in its final installed position in image forming device 22, and contact between forward facing surface 172 of rear stop 170 and rear side 343 of sensor housing 304 sets the final position of sensor housing 304 relative to toner cartridge 100 along front-to-rear dimension 126 of toner cartridge 100 in order to align sensor 300 along front-to-rear dimension 126 with the portion of disc 152 of encoded member 150 to be read by sensor 300. In other embodiments, because of the limited freedom of movement of sensor housing 304 relative to sensor mount 320 along front-to-rear dimension 126, rear stop 170 may be omitted so long as precise alignment of toner cartridge 100 relative to image forming device 22 along front-to-rear dimension 126 is achieved.

While the example embodiment illustrated includes various alignment guides for engaging sensor 300 positioned on side 108 of toner cartridge 100, near top 106 of toner cartridge 100, it will be appreciated that the alignment guides of toner cartridge 100 that engage and position sensor 300 relative to toner cartridge 100 may be positioned in other suitable locations and orientations depending on the positions and orientations of encoded member 150 and sensor 300. For example, in another embodiment, sensor housing 304 is biased upward instead of downward, and vertical alignment guide 160, rear stop 170 and axial alignment guide 180 are flipped vertically relative to the embodiment shown in FIG. 6 such that rear stop 170 and axial alignment guide 180 are positioned lower than vertical alignment guide 160, and a portion of a bottom surface of vertical alignment guide 160 angles downward and rearward for contacting and moving sensor housing 304 downward against its bias during insertion of toner cartridge 100 into image forming device 22 with front 110 of housing 102 leading. The alignment guides of toner cartridge 100, encoded member 150 and sensor 300 may take other suitable positions and orientations as desired.

Further, while the example embodiments discussed above include a toner agitator assembly 130 that includes a rotatable auger 132 and a rotatable drive shaft 134 having toner agitators 136 extending outward therefrom, it will be appreciated that toner agitator assembly 130 may include any suitable combination of rotating, shifting, reciprocating or otherwise movable toner agitators, which may take many shapes, forms, sizes and orientations. For example, the toner agitator(s) may include any suitable combination of one or more paddles, augers, rakes, combs, scoops, plows, arms, extensions, prongs, flaps, mixers, conveyors, screws, etc.

While the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202 and cleaner unit 204 are housed in one replaceable unit. In another embodiment, the main toner supply for image forming device 22 and developer unit 202 are provided in a first replaceable unit (with the developer roll or magnetic roll of developer unit 202 forming the outlet of the first replaceable unit) and cleaner unit 204 is provided in a second replaceable unit. Further, while the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow or magenta) and each imaging unit corresponding with one of the toner cartridges to permit color printing. Further, while the example embodiments illustrated pertain to a toner agitator assembly 130, an encoded member 150 and various alignment guides of a toner cartridge 100, it will be appreciated that they may apply to a toner agitator assembly, an encoded member and alignment guides of any toner container including, for example, a developer unit, an imaging unit or a waste toner container.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner container for use in an electrophotographic image forming device, comprising:

a housing having a reservoir for holding toner;

a rotatable gear positioned at a side of the housing of the toner container;

an encoded member encoded with identifying information of the toner container and operatively connected to the gear such that rotation of the gear causes movement of the encoded member for communicating the identifying information of the toner container to a sensor of the image forming device when the toner container is installed in the image forming device, at least a portion of the encoded member is exposed on the side of the housing of the toner container; and an alignment guide on the side of the housing of the toner container, the alignment guide is configured to contact and move a sensor housing in the image forming device during insertion of the toner container into the image forming device to align the sensor of the image forming device with the exposed portion of the encoded member.

2. The toner container of claim 1, wherein the alignment guide is positioned below the exposed portion of the encoded member.

3. The toner container of claim 1, wherein the alignment guide is positioned in front of the exposed portion of the encoded member relative to an insertion direction of the toner container into the image forming device.

4. The toner container of claim 1, wherein the alignment guide is configured to contact and lift the sensor housing in the image forming device upward during insertion of the toner container into the image forming device to vertically align the sensor of the image forming device with the exposed portion of the encoded member.

5. The toner container of claim 1, wherein the alignment guide is configured to contact and move the sensor housing in the image forming device axially relative to a rotational axis of the gear during insertion of the toner container into the image forming device to axially align the sensor of the image forming device with the exposed portion of the encoded member.

6. The toner container of claim 1, wherein the encoded member is rotatably connected to the gear such that rotation of the gear causes rotation of the encoded member.

7. The toner container of claim 6, wherein the encoded member is positioned on an axially outboard face of the gear that faces away from the reservoir.

8. The toner container of claim 1, wherein the alignment guide extends outward from the side of the housing of the toner container.

9. A toner container for use in an electrophotographic image forming device, comprising:

a housing having a reservoir for holding toner;

a rotatable gear positioned at a side of the housing of the toner container;

an encoded member encoded with identifying information of the toner container and rotatably connected to the gear such that rotation of the gear causes rotation of the encoded member for communicating the identifying information of the toner container to a sensor of the image forming device when the toner container is installed in the image forming device, the encoded member is positioned on an axially outboard face of the gear that faces away from the reservoir; and an alignment guide on the side of the housing of the toner container, the alignment guide is configured to contact and move a sensor housing in the image forming device during insertion of the toner container into the image forming device to align the sensor of the image forming device with the encoded member.

10. The toner container of claim 9, wherein the alignment guide is configured to contact and lift the sensor housing in the image forming device upward during insertion of the toner container into the image forming device to vertically align the sensor of the image forming device with the encoded member.

11. The toner container of claim 9, wherein the alignment guide is configured to contact and move the sensor housing in the image forming device axially relative to a rotational axis of the gear during insertion of the toner container into the image forming device to axially align the sensor of the image forming device with the encoded member.

12. The toner container of claim 9, wherein the alignment guide extends outward from the side of the housing of the toner container.

* * * * *